US005529637A

United States Patent [19]

Frenier

[11] Patent Number: 5,529,637

[45] Date of Patent: Jun. 25, 1996

[54] FORMIC-CARBOXYLIC ACID MIXTURES FOR REMOVING IRON OXIDE SCLAE FROM STEEL SURFACES

[75] Inventor: Wayne W. Frenier, Katy, Tex.

[73] Assignee: HydroChem Industrial Services, Inc., Houston, Tex.

[21] Appl. No.: 390,120

[22] Filed: Feb. 17, 1995

Related U.S. Application Data

[63] Continuation-in-part of Ser. No. 197,595, Feb. 17, 1994, abandoned.

[51] Int. Cl.[6] ..... B08B 3/08; B08B 9/00; C23G 1/02; C23G 1/08

[52] U.S. Cl. ..... 134/3; 134/10; 134/22.13; 134/22.14; 134/22.16; 134/22.17; 134/22.19; 134/41

[58] Field of Search ..... 134/22.14, 22.19, 134/22.13, 22.16, 22.17, 10, 3, 41; 252/80, 103, 156; 210/724, 722

[56] References Cited

U.S. PATENT DOCUMENTS

| | | | |
|---|---|---|---|
| 1,892,093 | 12/1932 | Battistella . | |
| 2,084,361 | 6/1937 | Vanderbilt | 148/8 |
| 2,423,385 | 7/1947 | Hixson et al. | 134/10 |
| 2,462,341 | 2/1949 | Tremaine | 252/100 |
| 2,516,685 | 7/1950 | Douty | 252/100 |
| 3,003,898 | 10/1961 | Reich | 134/22.19 |
| 3,003,899 | 10/1961 | Eberhard et al. | 134/22.14 |
| 3,072,502 | 1/1963 | Alfano | 134/3 |
| 3,171,800 | 3/1965 | Rice et al. | 210/722 |
| 3,296,143 | 1/1967 | Boiko | 252/87 |
| 3,298,931 | 1/1967 | Herbert et al. | 203/7 |
| 3,492,238 | 1/1970 | Wohlberg | 252/87 |
| 3,530,000 | 9/1970 | Searles | 134/22.1 |
| 3,915,633 | 10/1975 | Ramachandran | 8/137 |
| 4,174,290 | 11/1979 | Leveskis | 134/3 |

(List continued on next page.)

FOREIGN PATENT DOCUMENTS

| | | | |
|---|---|---|---|
| 77/041270 | 2/1979 | Japan . | |
| 0041270 | 4/1979 | Japan | 210/722 |
| 82/014391 | 12/1983 | Japan . | |
| 0214391 | 12/1983 | Japan | 210/722 |

OTHER PUBLICATIONS

McLaughlin, L. G., "Improved Acid Solution for Boilers Removes Oxides Without Precipitate", E. I. du Pont de Nemours & Co., Inc., Wilmington, Delaware, Aug. 1963, pp. 52, 54 and 57.

(List continued on next page.)

*Primary Examiner*—Jill Warden
*Assistant Examiner*—Zeinab El-Arini
*Attorney, Agent, or Firm*—Browning, Bushman, Anderson & Brookhart

[57] ABSTRACT

Methods and solutions useful for removing iron oxide-containing scale from the interior surfaces of steel. An aqueous cleaning solution containing formic acid and at least one carboxylic acid having at least two carbon atoms wherein the weight ratio of formic acid to higher carboxylic acid is greater than about 4:1 is contacted with the scale in the absence of an oxidizing agent. Preferred carboxylic acids are the mono-, di-, hydroxy-, and polyhydroxy-carboxylic acids having from two to six carbon atoms. More preferrably, the aqueous solution includes about 0.5–10.0 percent-by-weight in total of such acids wherein the weight ratio of formic acid to higher carboxylic acid is from about 4:1 to about 9:1, together with an effective amount of an organic acid corrosion inhibitor and, optionally, a scale dissolution accelerating agent. Preferrably, contact is under a reducing atmosphere, at a temperature in the range of about 150°–200° F. and a pH less than 7. More preferrably, the cleaning solution is circulated through the vessel for a time less than 30 hours. These high ratio formic/carboxylic acid solutions are capable of holding more iron in solution than low ratio solutions, especially in a reducing atmosphere where iron is maintained in the ferrous state.

25 Claims, 23 Drawing Sheets

U.S. PATENT DOCUMENTS

| | | | |
|---|---|---|---|
| 4,595,517 | 6/1986 | Abadi | 252/82 |
| 4,637,899 | 1/1987 | Kennedy Jr. | 252/542 |
| 4,855,069 | 8/1989 | Schuppiser et al. | 252/87 |
| 5,021,096 | 6/1991 | Abadi | 134/22.1 |
| 5,045,352 | 9/1991 | Mueller | 427/235 |
| 5,360,488 | 11/1994 | Hieatt et al. | 134/22.14 |

OTHER PUBLICATIONS

Frenier et al., "Mechanism of Iron Oxide Dissolution—A Review of Recent Literature", Corrosion, vol. 40, No. 12, pp. 663–668, Dec. 1984.

Frenier, Wayne, "The Mechanism of Magnetite Dissolution in Chelant Solutions", Corrosion, vol. 40, No. 4, pp. 176–180, Apr. 1984.

Iron vs Time for 2% F/C 4/1 at 200 F
SoCal Ed Tubes, 0.2% Inh "A"

Iron vs Time for 2% F/C 4/1 at 200 F
SoCal Ed Tubes, 0.3% Inh "A"

Iron vs Time for 2% F/C 9/1 at 150 F
SoCal Ed Tubes, 0.2% Inh "B"

Iron vs Time for 2% F/C 9/1 at 200 F
SoCal Ed Tubes, 0.3% Inh "A"

Iron vs Time for 2% F/C 9.0/1 at 150 F
CG & E Tubes, 0.1% Inh "B"

Iron vs Time for 2% F/C 9/1 at 200 F
CG & E Tubes, 0.2% Inh "A"

Iron vs Time for 2% F/C 9/1 at 200 F
CG & E Tubes, 0.2% Inh "B"

Iron vs Time for 2% 4/1 F/For at 200°F
PENELEC-II Tubes, 0.25% A251

Iron vs Time for 2% 4/1 F/Gly at 200°F
PENELEC -II Tubes, 0.25% A251

Iron vs Time for 2% 4/1 F/Lac at 200°F
PENELEC-II Tubes, 0.25% A251

Iron vs Time for 2% 4/1 F/Mln at 200°F
PENELEC-II Tubes, 0.25% A251

Iron vs Time for 2% 4/1 F/Fum at 200°F
PENELEC -II Tubes, 0.25% A251

Iron vs Time for 2% 4/1 F/Suc at 200°F
PENELEC-II Tubes, 0.25% A251

Iron vs Time for 2% 4/1 F/Glu at 200°F
PENELEC-II Tubes, 0.25% A251

Iron vs Time for 2% 4/1 F/Malic at 200°F
PENELEC -II Tubes, 0.25% A251

Iron vs Time for 2% 4/1 F/Tar at 200°F
PENELEC-II Tubes, 0.25% A251

[Fe(II)] vs Time for 2% 4/1 Formic/Alt. Acid

Total Spending with Fe Powder at 200°F

[Fe(II)] vs Time for 2% 4/1 Formic/Alt. Acid

Total Spending with Fe Powder at 200°F

[Fe(II)] vs pH Curves for F/C 6.5/1 and F/C 9/1

[Fe(III)] vs pH for 2% 4/1 Formic/Alt. Acid

[Fe(III)] vs pH for 2% 4/1 Formic/Alt. Acid

[Fe(III)] vs pH for 2% 4/1 Formic/Alt. Acid

FORMIC-CARBOXYLIC ACID MIXTURES FOR REMOVING IRON OXIDE SCLAE FROM STEEL SURFACES

This application is a Continuation-in-Part of my prior pending U.S. patent application Ser. No. 08/197,595, filed on Feb. 17, 1994, now abandoned.

FIELD OF THE INVENTION

The present invention is directed to cleaning solutions and methods useful for removing iron-containing scale from the interior surfaces of steel vessels. The cleaning solutions comprise solutions of formic and higher carboxylic acids, preferrably including an organic acid corrosion inhibitor and a scale dissolution accelerating agent, which are intended for use in an inert or reducing atmosphere. The invention further comprises simple methods for precipitating dissolved metals from the spent cleaning solutions to produce environmentally acceptable wastes.

DESCRIPTION OF THE BACKGROUND

The steel plates and tubes which typically provide the internally available surfaces of drumless boilers are often constructed of various steel alloys which lack copper. Alloys known to the present inventor to be frequently encountered include A515Gr70 Boiler Plate, ASTM A182F22 (A213T22)—2¼ percent Cr, ASTM A182F11 (A213T11)—1¼ percent Cr, ASTM A213T2—½ percent Cr, and ASTM A182F1—½ percent Mo.

Drumless boilers, e.g., Babcock & Wilcox Universal Pressure and Combustion Engineering supercritical units, do not circulate water in the tubes, but operate with "once-through" cycles. This fact, as well as a lack of copper-based metallurgy in the feedwater train of such boilers, and consistently high-quality water chemistry used in the operation of such boilers, causes the deposits which inevitably form in the tubes of those drumless boilers to be magnetite ($Fe_3O_4$) of a fairly consistent composition, without the copper that is often found in the deposits that form in drum boilers.

When magnetite is dissolved in the presence of an iron surface or iron is corroded by acid, Fe(II) ions are released into solution:

$$Fe_3O_4+8H^+=2Fe^{+3}+Fe^{+2}+4H_2O \quad (1)$$

$$Fe+2Fe^{+3}=3Fe^{+2} \quad (2)$$

$$Fe+Fe_3O_4+8H^+=4Fe^{+2}+4H_2O \quad (3)$$

$$Fe+2H^+=H_2+Fe^{+2} \quad (4)$$

It is known that EDTA solvent-based cleaning solutions, e.g., solutions of $(NH_4)_4$ EDTA and $(NH_4)_2$ EDTA, will readily remove magnetite deposits from the internal surfaces of drumless boilers. The expense of EDTA solvents, however, has caused chemical cleaning service providers to focus on less expensive cleaning alternatives.

The Reich patent (U.S. Pat. No. 3,003,898, issued Oct. 10, 1961) discloses a method and composition for removing scale and tenacious foreign matter from the internal surfaces of metal-walled (typically steel-walled) vessels used for storing, transferring or circulating fluids. Typical are the surfaces of boiler and heat exchanger tubes, transfer lines and storage tanks. It is believed that the methods and compositions disclosed in the Reich patent were used commercially in the United States from the 1960s until 1985.

The invention claimed in Reich was predicated upon the discovery that a synergistic effect on the cleaning of scale and other adhesive foreign matter from steel surfaces apparently was obtained by using a cleaning solution comprising an aqueous solution containing between 0.2 and 20.0 percent-by-weight of a mixture of formic acid and citric acid, in which the ratio of formic acid to citric acid was between 1:6 and 3:1. Reich reported that the use of pure acids or mixtures outside the foregoing range was unacceptable because of the formation of a sludgy precipitate believed to be ferric citrate at lower ratios and hydrated ferric oxide at higher ratios. See FIG. 4 of the Reich patent which teaches that, under the conditions investigated by Reich, iron titrate precipitated from the solution if the weight ratio of formic acid to citric acid was less than 1:6, and hydrated ferric oxide precipitated from the solution if the weight ratio of formic acid to citric acid was greater than 3:1.

The apparatus used by Reich for the tests to determine the effects of aqueous cleaning solutions including formic acid, citric acid, and mixtures of the two acids was not an actual steam boiler or equivalent industrial apparatus. Reich employed a reflux condenser, apparently used without precautions to exclude air or to provide an inert or reducing atmosphere. The present inventor concludes from his reading of Reich that air was able to enter Reich's experiment; otherwise, he would not have been stabilizing ferric oxide, in which the iron is in the ferric oxidation state. Introduction of air into utility boilers is uncharacteristic of at least present day chemical solution-based cleaning of iron oxide from the internal surfaces of utility boilers and similar industrial equipment.

Reich further taught that the temperature of the aqueous acidic solutions contacting the scale should be maintained between 150° F. and their boiling points, preferrably between 200° F. and their boiling points. Thereafter, the solutions should be heated to at least 212° F., preferably above their boiling points to decompose any remaining acid. Reich also taught that the solutions should contain between 0.1 and 1.0 percent-by-weight of a corrosion inhibitor such as those described in U.S. Pat. Nos. 2,403,153; 2,606,873; 2,510,063; and 2,758,970, all of which are incorporated herein by reference. Reich also suggested that the solutions should contain 0.01 to 0.1 percent-by-weight of a wetting agent exemplified by a condensation product produced by condensing ethylene oxide with di-secondary butylphenol in a proportion of about 10 moles of ethylene oxide to 1 mole of di-secondary butylphenol.

For ensuring adequacy of disclosure without unnecessarily lengthening this text, the specification of the Reich patent is incorporated herein by reference.

For reasons unknown to the present inventor, the scale removing chemical of choice over the last several years, at least since 1985, has been a solvent based on a mixture of glycolic acid and formic acid present in a 2:1 weight ratio and typically totaling 3.0 percent-by-weight of an aqueous solution. These glycolic acid-formic acid solutions generally also include an inhibitor and a scale removal accelerating agent.

Use of these aqueous solutions of glycolic acid-formic acid mixtures is more expensive than use of the aqueous formic acid-citric acid solutions within the concentration and proportion ranges and under the conditions taught in the Reich patent. However, both are less expensive than using EDTA-based solvents. Cleaning times using the method taught in the Reich patent tend to be comparable to those experienced using aqueous solutions of glycolic acid-formic acid mixtures as the solvent, e.g., from about 20 percent longer to about 20 percent shorter.

A strong motivation of the present inventor to re-explore the cleaning of drumless boilers using an aqueous solvent solution based on a mixture of formic acid and citric acid was the prospect of savings in chemical costs. Because formic acid is less expensive than citric and other carboxylic acids, higher ratios of formic acid to carboxylic acid offer the possibility of significant cost savings.

Among the important criteria that a chemical cleaning service provider or customer typically may specify in connection with a contract for chemically cleaning the interior of a drumless boiler are the following:

that the boiler tubes be cleaned within 30 hours or less of contact with the cleaning solution;

that the cleaning be performed at a temperature within the range between 150° F. and 200° F.;

that the solvent be adequately inhibited to prevent excessive attack on the bared metal of the boiler, e.g., a corrosion rate below 0.015 lb/ft$^2$/day (Basically the higher the temperature, the more the chromium in the alloy, the greater the acid concentration, or the higher the flow rate, the higher will be the necessary concentration of expensive corrosion inhibitors, all other factors being equal.);

that the solution be able to retain at least 0.7 percent-by-weight of iron in the ferrous state for at least 24 hours; and that the concentrations of metals dissolved into the solution be reducible to below 1 ppm by conventional waste treatment methods, e.g., the addition of lime, caustic, peroxide or air.

The chemical cleaning industry has long sought inexpensive and effective cleaning solutions and methods meeting all of the foregoing criteria. Those needs have now been filled by the present invention.

SUMMARY OF THE INVENTION

The present invention is directed to methods for removing iron oxide-containing scale from the interior surfaces of steel vessels, e.g., utility boilers, in the absence of an oxidizing agent and preferrably under an inert or reducing atmosphere. The methods comprise contacting the scale under a reducing atmosphere with an aqueous cleaning solution containing formic acid and at least one carboxylic acid having at least two carbon atoms wherein the weight ratio of formic acid to higher carboxylic acid is greater than about 4:1. Preferrably, the carboxylic acid has from two to six carbon atoms, and is more preferrably selected from the group consisting of the mono-carboxylic acids, the dicarboxylic acids, the hydroxycarboxylic acids and the polyhydroxycarboxylic acids. Preferrably the weight ratio of formic acid to carboxylic acid is from about 4:1 to about 20:1, more preferrably from about 4:1 to about 9:1, and most preferrably from about 4:1 to about 6.5:1.

In the preferred method and solutions, the aqueous cleaning solution comprises from about 0.5 to about 10.0 percent-by-weight in total of the formic acid and higher carboxylic acid, together with from about 0.1 to about 1.0 percent-by-weight of a corrosion inhibitor effective to inhibit the corrosive attack of organic acids on steel to no more than about 0.015 lb/ft$^2$/day at the cleaning temperature. More preferrably, the solution and method include up to about 1.0 percent-by-weight of a scale dissolution accelerating agent selected from the group consisting of hydrofluoric acid and ammonium bifluoride.

In the methods of the present invention, cleaning solutions in accord with the foregoing requirements are preferrably circulated through the vessel at a temperature between 150° F. and the boiling point of the solution for a time less than 30 hours. More preferrably cleaning is conducted at temperatures between about 150° F. and about 200° F. Contacting of the solutions with the scale to be removed should be conducted in the absence of an oxidizing agent, preferrably under an inert or reducing atmosphere.

Finally, the present invention provides solutions from which the dissolved metals, primarily iron, but also including nickel, zinc, chromium and other heavy metals, may be easily precipitated. Accordingly, in another aspect of the present invention, the spent cleaning solutions, including dissolved metals from the scale removed from the steel vessels, is drained from the vessel. The dissolved metals are readily precipitated from the spent cleaning solution by raising the pH to at least about 11.0, preferrably 12.0 and more preferrably 12.5. This may be achieved by the addition of lime and caustic to precipitate the dissolved metals as metal hydroxides. An oxidation stage may not be required to remove dissolved iron to below 1 ppm from the solution during waste treatment procedures using lime and caustic. However, addition of a sufficient amount of an oxidizing agent, preferrably peroxide, oxygen or air, to the remaining solution will decompose some of the remaining carboxylic acid, convert the iron to a less-soluble ferric hydroxide and permit more complete precipitation of the heavy metals.

The high formic acid to carboxylic acid ratios required by the present invention unexpectedly hold more iron in solution than the low formic acid to carboxylic acid ratios investigated in the past, especially if the iron is kept in the ferrous oxidation state. Accordingly, exclusion of oxidizing agents during the cleaning operation is important. Because more iron can be held in solution, less acid is required to perform the cleaning operations.

The ability of the solution to hold dissolved iron is only slightly dependent on pH, provided that the pH is maintained below 7.0.

The present invention provides methods and solutions useful for removing iron oxide-containing scale from the interior surfaces of steel vessels. The solutions and methods are less expensive and more convenient than solutions and methods heretofore used in the chemical cleaning industry. Further, these solutions and methods solve many of the problems associated with the cleaning of drumless boilers and other closed systems. These and other meritorious features and advantages of the present invention will be more fully appreciated from the following detailed description and claims.

Figure 1A:
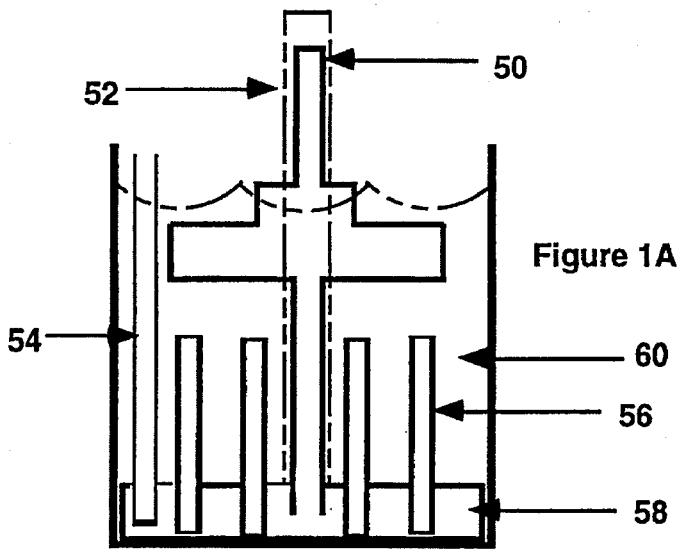
FIGS. 1A, 1B, and 1C are, respectively, front, side and top illustrations of the orientation of corrosion coupons in the stirred Parr bomb used to evaluate corrosion inhibitors.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PREFERRED EMBODIMENT

The present invention provides methods for removing iron oxide-containing scale from the interior surfaces of steel vessels, e.g., drumless boilers. In its broadest embodiment, the present invention comprises contacting in the absence of an oxidizing agent the scale with an aqueous cleaning solution containing formic acid and at least one carboxylic acid having at least two carbon atoms wherein the weight ratio of formic acid to higher carboxylic acid is greater than about 4:1. Preferrably, an inert or reducing atmosphere is maintained in the vessel. More preferrably, a reducing atmosphere may be generated in situ by the production of hydrogen from corrosion of the base metal during scale dissolution. Alternatively, an inert gas, e.g., nitrogen may be injected into the vessel.

While it is believed that any carboxylic acid may be used as the second acid, practical limitations of solubility and costs limit the acids of choice to those having from two to six carbon atoms. Preferrably, the carboxylic acid is selected from the group consisting of the mono-carboxylic acids, the dicarboxylic acids, the hydroxycarboxylic acids and the polyhydroxycarboxylic acids. Exemplary carboxylic acids useful in the present invention include acetic, propionic, glycolic, lactic, malonic, fumaric, succinic, glutaric, malic, tartaric, gluconic and citric acids. Presently preferred are the hydroxy and polyhydroxycarboxylic acids, most preferrably glycolic, malic, lactic, citric and gluconic acids. Most preferred is citric acid.

While the methods of the present invention appear to provide acceptable scale removal at all weight ratios greater than about 4:1, it must be remembered that some higher carboxylic acid must be present to avoid the undesirable precipitation of hydrated ferric oxide which results if formic acid is used alone. Because formic acid is less expensive than the other carboxylic acids, higher ratios would be preferred in order to minimize costs. Further, higher ratios result in spent solutions from which the dissolved metals can be more easily precipitated. However, cost savings must be balanced against increased corrosion and pitting which become more pronounced at higher ratios. Accordingly, the ratio of formic acid to carboxylic acid, while maintained above about 4:1, preferrably should be maintained below about 20:1, more preferrably below about 9:1, and most preferrably below about 6.5:1.

Solutions in accord with the present invention and for use in the methods of the present invention preferrably contain from about 0.5 to about 10.0 percent-by-weight of the combined formic acid-carboxylic acid mixture. It has been found that solutions containing from about 2.0 to about 4.0 percent-by-weight provide an efficient cleaning operation while maintaining low cost.

In order to prevent excessive corrosion of the exposed metal surfaces, it has been found that the aqueous cleaning solutions of the present invention should preferrably include a corrosion inhibitor effective to inhibit the corrosive attack of organic acids on steel. Preferrably, these cleaning solutions include an amount of such corrosion inhibitor effective to limit the corrosion of bared steel to no more than about 0.015 $lb/ft^2/day$ at the cleaning temperatures, generally from about 150° F. to about 200° F. The desired level of corrosion inhibition can usually be obtained by the inclusion of about 0.1 to about 1.0 percent-by-weight of corrosion inhibitor in the cleaning solution. Those skilled in the art will be aware that higher concentrations of corrosion inhibitor will be required in more severe conditions, i.e., at higher temperatures and acid concentrations. Any well known commercially available corrosion inhibitor, e.g., those described in the patents incorporated above, may be employed. In the examples herein, two different corrosion inhibitors were employed. Inhibitor "A" (Inh "A")is a commercially available organic acid corrosion inhibitor sold under the name A224 by HydroChem Industrial Services, Inc. including organic amines, ethylene glycol and aromatic petroleum solvents. Inhibitor "B" (Inh "B") is an organic acid corrosion inhibitor based upon U.S. Pat. No. 4,637,899, incorporated herein by reference. While the chemical cleaning solutions of the present invention may be contacted with the scale to be removed at ambient temperature under static conditions, those skilled in the art will be aware that contact under more rigorous conditions will improve and hasten scale removal. Accordingly, it is preferred to conduct cleaning processes in accord with the present invention at elevated temperatures and with circulating solutions. While temperatures as high as the boiling point of the cleaning solution may be employed, it is preferred to conduct the processes of the present invention at temperatures between about 150° F. and about 200° F.

The present invention provides methods for effectively and economically removing scale from steel vessels in under 30 hours. In fact, a significant portion of the scale will be removed in the first two hours with most of the scale removed in less than 6 hours. In this regard, it has been found that incorporation of a scale dissolution accelerating agent within the cleaning solution hastens scale removal. Known accelerating agents include hydrofluoric acid, ammonium bifluoride, ascorbic acid and its optical isomers. The addition of accelerating agents at concentrations up to about 1.0 percent-by-weight of the cleaning solution is preferred. In another aspect of the present invention, the metals dissolved from the surface of the steel vessels may be conveniently and inexpensively removed from the spent cleaning solution. In this aspect of the present invention, the spent cleaning solution is drained from the vessel. The pH of the solution is then raised to at least about 11.0, preferrably to at least about 12.0 and more preferrably to at least about 12.5. The pH is conveniently raised by the addition of lime (calcium hydroxide) and caustic (sodium hydroxide) to the spent cleaning solution. At this elevated pH, many metals, including iron and other heavy metals, will precipitate as the hydroxides. Further, by adding lime, calcium carboxylates, e.g., calcium citrate, may also be precipitated. Finally, if it is desired to further reduce the dissolved metal content of the spent cleaning solutions, remaining heavy metals may be precipitated by addition of an oxidizing agent to the spent solutions at a pH of at least about 12.0, preferrably at least about 12.5. Exemplary oxidizing agents include peroxide, persulfate, hypochlorite, ozone, oxygen and air. Most preferred is the addition of hydrogen peroxide or the bubbling of air through the solution. The oxidizing agent will decompose some carboxylates, including citrates, accelerating and improving precipitation of the iron and other heavy metals. By following the foregoing procedure, the concentration of heavy metals, including iron, in the spent cleaning solution is readily reduced to less than about 1 ppm.

The present invention will be more fully understood with the following specific examples. In the following examples and in the accompanying figures, specific carboxylic acids may be abbreviated as follows:

| | | |
|---|---|---|
| Formic Acid (F or For) | Lactic Acid (Lac) | Glutaric Acid (Glu) |
| Acetic Acid (Ac) | Malonic Acid (Mln) | Malic Acid (Mal) |
| Propionic Acid (Pro) | Fumaric Acid (Fum) | Tartaric Acid (Tar) |
| Glycolic Acid (Gly) | Succinic Acid (Suc) | Citric Acid (C or Cit) |

Scale dissolution tests were conducted using boiler tubing obtained from three operating drumless boilers. All of the tubes were milled to remove fireside scale prior to testing, leaving only scale that had deposited on the tube sides which, in use, had been in contact with boiler water and steam. The tubes were cut into 1-inch long rings, identified as follows:

Sample set 1 comprised rings of A213T2 boiler tubing from American Electric Power, Appalachian Power, Mountaineer Station, a Babcock & Wilcox Universal Pressure boiler. Prior to testing, the boiler from which these tubes were taken had most previously been cleaned in 1991, using a 4.0 percent-by-weight aqueous solution of 2 parts glycolic acid and 1 part formic acid. Scale loading (HCl weight loss) was 36 g/ft$^2$.

Sample set 2 comprised rings of A213T11 boiler tubing from Southern California Edison, Mohave Station, a Combustion Engineering supercritical unit. Its previous cleaning history was unknown. Scale loading (HCl weight loss) was 25 g/ft$^2$.

Sample set 3 comprised rings of A213T2 boiler tubing from Cincinnati Gas & Electric, Zimmer Plant, a Babcock & Wilcox supercritical boiler. Prior to testing, the boiler from which these tubes were taken had most previously been cleaned in May 1993, using a 3.0 percent by weight aqueous solution of 2 parts glycolic acid and 1 part formic acid, which also contained 0.25 percent-by-weight ammonium bifluoride (as a scale dissolution accelerating agent), and 0.2 percent-by-weight of Inh "B" as a corrosion inhibitor. The tubes used in sample set 3 were removed prior to the boiler being cleaned.

The nominal surface to volume ratio of the experiment was 0.5/cm. The surfaces of sample sets 1 and 2, upon microscopic examination, were more pitted than those of sample set 3. Inhibitor film, thus, has more surface to cover in the former two instances than in the latter one.

The presently preferred inhibitors are Inh "A" which is added to the test solution to an extent of between 0.1 and 1.0 volume percent, preferably 0.2–0.3 volume percent, and Inh "B", which is added to the solution to an extent of between 0.1 and 1.0 volume percent, preferably 0.2–0.3 volume percent. Alternatives include known organic acid inhibitors which will give a corrosion rate of less than 0.015 lb/ft$^2$/day in the following test.

Figure 1B:
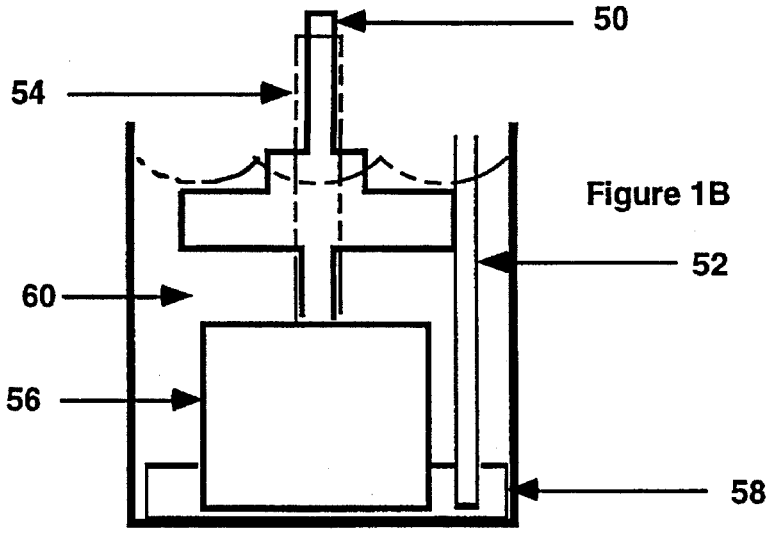
Figure 1C:
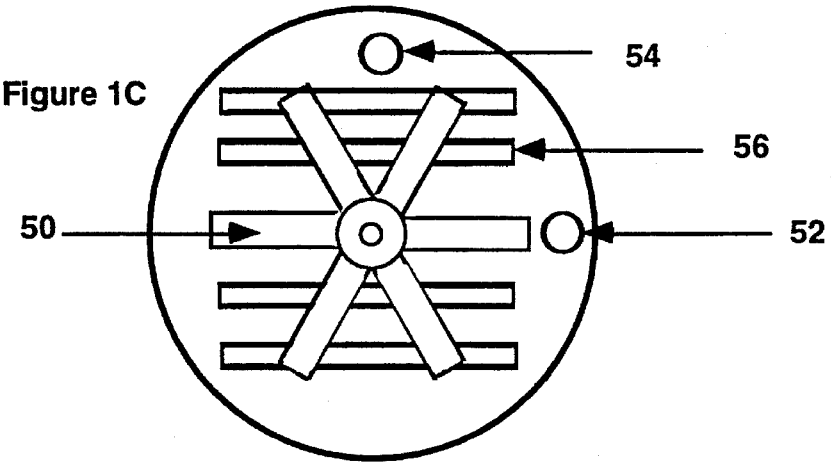

The test is described with references to the apparatus illustrated in FIGS. 1A, 1B and 1C. Four steel corrosion test coupons 56 are placed in a Teflon™ holder 58 and then placed in a 1000 ml Parr bomb. Enough of the inhibited cleaning solution 60 is added to the bomb to give a surface/volume ratio of at least 0.6/cm. The bomb is stirred at 70 rpm with stirrer 50 for 6 hours at the test temperature. The Parr bomb further includes a thermal well 52 and a dip tube 54. At least three different metals should be tested, including boiler plate, mild steel (such as 1018 CS) and one low alloy steel such as A213T11 (1¼ percent Cr).

In each of the tests, 350 ml of inhibited solvent mixture aqueous solution was placed in contact with four rings of the respective set in a standard Parr bomb, having an internal volume of 1000 ml, heated to 150° F. or 200° F., pressurized to 100 psig with nitrogen, and stirred at 70 rpm. The respective solution was sampled for iron concentration for 30 hours. The tube rings then were removed and cleaning effectiveness was determined visually. Corrosion tests were then run on the cleaned tubes, using fresh solvent.

Optionally, the cleaning solution may include a scale dissolution accelerating agent. Ammonium bifluoride or hydrofluoric acid at less than 1.0 percent-by-weight are exemplary scale dissolution accelerators.

Cleaning time was estimated from noting the leveling point in the iron concentration versus time curves, and the corrosion rate was calculated from the difference in iron concentration at the leveling and final points. As a check, the corrosion rate also was calculated from 24 hours of exposure of cleaned tubes to fresh solvent solution.

Used cleaning solutions were treated with one percent lime, and enough caustic to raise the pH to 12.8, after which air was blown through the mixture until the resulting slurry was red brown in color. If at least a 2:1 mole ratio of lime to iron was used, the final iron concentration was less than 1 ppm. If concentration of chromium in the used cleaning solution is less than 20 ppm, it also will be reduced to less than 1 ppm, by the above-described treatment. Peroxide or other oxidizing agents may be used in addition to or in place of air, for lowering the concentrations of iron, nickel, chromium, zinc and other commonly encountered heavy metals, to less than 1 ppm.

The Parr bomb tests are believed to reliably simulate the actual cleaning of a drumless boiler using a cleaning solution of the same composition. However, for those not familiar with how such a boiler would be cleaned using the process of the present invention, a generic cleaning process is briefly described as follows:

A utility power boiler consists of thousands of feet of tubing (½ inch to about 1½ inches in diameter) that surround the fire box. The steam to drive the turbines that generate electricity is produced inside the tubes. The surface/volume ratio of a drumless boiler is about 1.0/cm. During the cleaning process, the boiler tubing is filled with water, and then the cleaning acids and inhibitors are injected into boiler. Frequently, there is a chemical cleaning tank provided to facilitate injection of the cleaning chemicals. To achieve the desired dissolution of the magnetite, the cleaning solution should be circulated through the tubes and should be heated from about 150° F. to about 200° F. to speed the dissolution reactions. High volume pumps are provided by the cleaning contractor if the utility does not have the capability to circulate the cleaning solution. Heat usually is provided by circulating the cleaning solution through a heat exchanger. During the cleaning process, all vents are closed so that air is excluded from entering the system. Hydrogen gas generated in the process of the present invention during dissolution of the corroded metals insures that the cleaning takes place under reducing conditions. The progress of the job can be monitored by determining the concentration of iron, free (unused) acid and pH (which will rise as the acid is spent). When the iron concentrations, free acid and pH have stabilized, the spent cleaning solution is drained to a holding tank and the boiler is flushed with very clean water. This usually is followed by a neutralizing rinse of ammoniated water, frequently containing hydrazine or a hydrazine derivative. This process leaves the metal surfaces in a passivated condition.

All of the cleaning solutions and rinses must be treated to remove heavy metals or otherwise given disposal treatments in compliance with local and federal laws.

Sample Set 1

For comparative purposes, a 3.0 percent aqueous solution of 2 parts glycolic acid and 1 part formic acid containing 0.2 percent Inh "B" as a corrosion inhibitor was found to clean these tube rings within 8 hours at 200° F., with an acceptably low corrosion rate of 0.0045 lb/ft$^2$/day.

Also, for comparative purposes, a 2.0 percent aqueous solution of 2 parts formic acid and 1 part citric acid inhibited with either 0.1 to 0.2 percent Inh "A" or 0.1 to 0.2 percent Inh "B" was found to clean these tube rings within 12 hours at temperatures between 150° F. and 200° F., with an acceptably low corrosion rate of 0.004 to 0.020 lb/ft$^2$/day.

Also, for comparative purposes, a 2.0 percent aqueous solution of formic acid, inhibited with 0.2 percent Inh "B" was found to leave about 5 percent of the original scale on the tube rings at 30 hours with a corrosion rate of 0.008 lb/ft$^2$/day.

Figure 2:
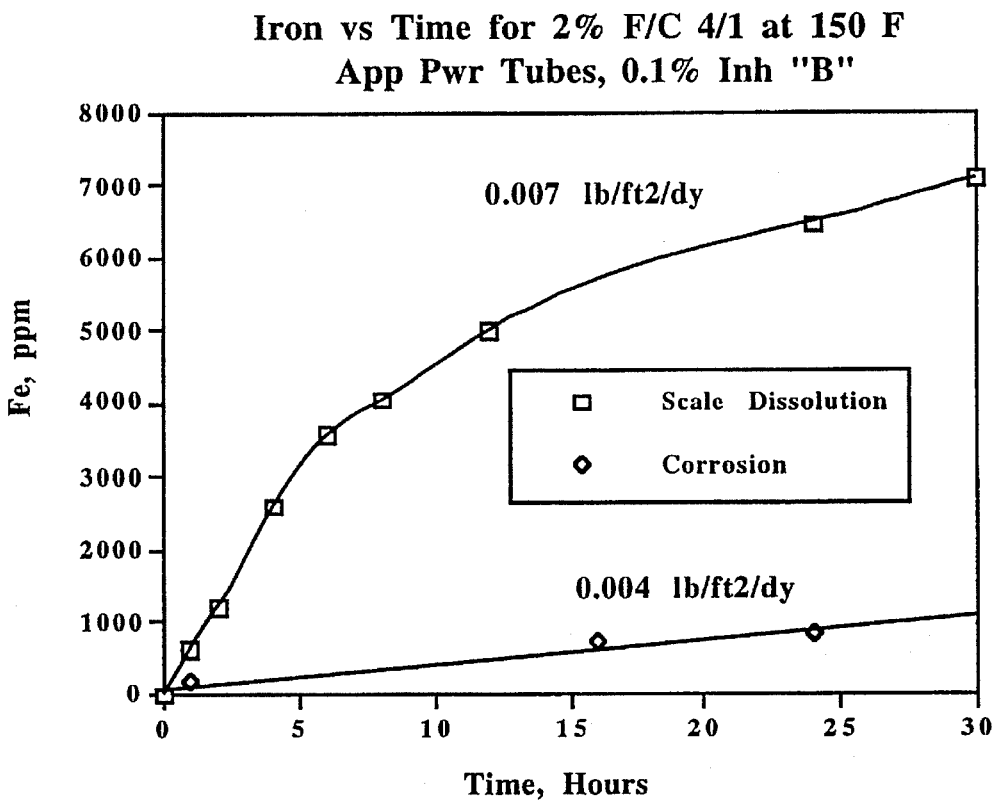
FIGS. 2–26 are graphical illustrations of the results of tests of removal of magnetite from the internal surfaces of drumless boilers using aqueous solutions of formic acid and citric acid within the range of weight ratios from 4:1 to 9:1 in processes in accord with the present invention.
Figure 3:
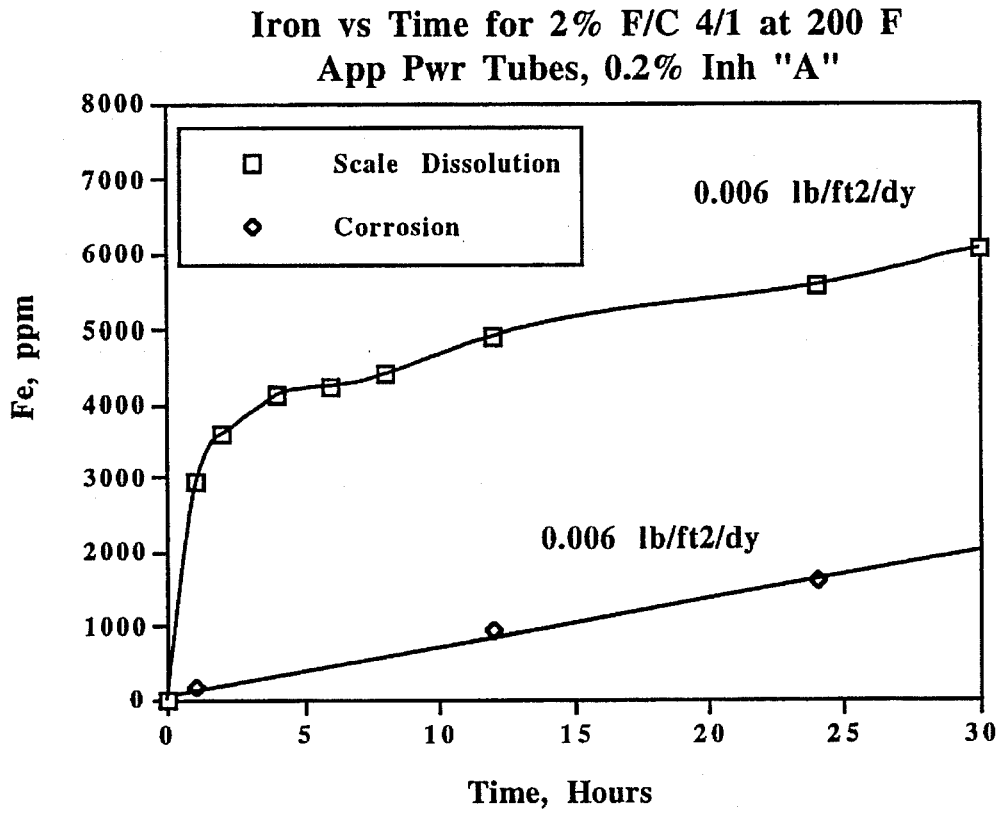
Figure 4:
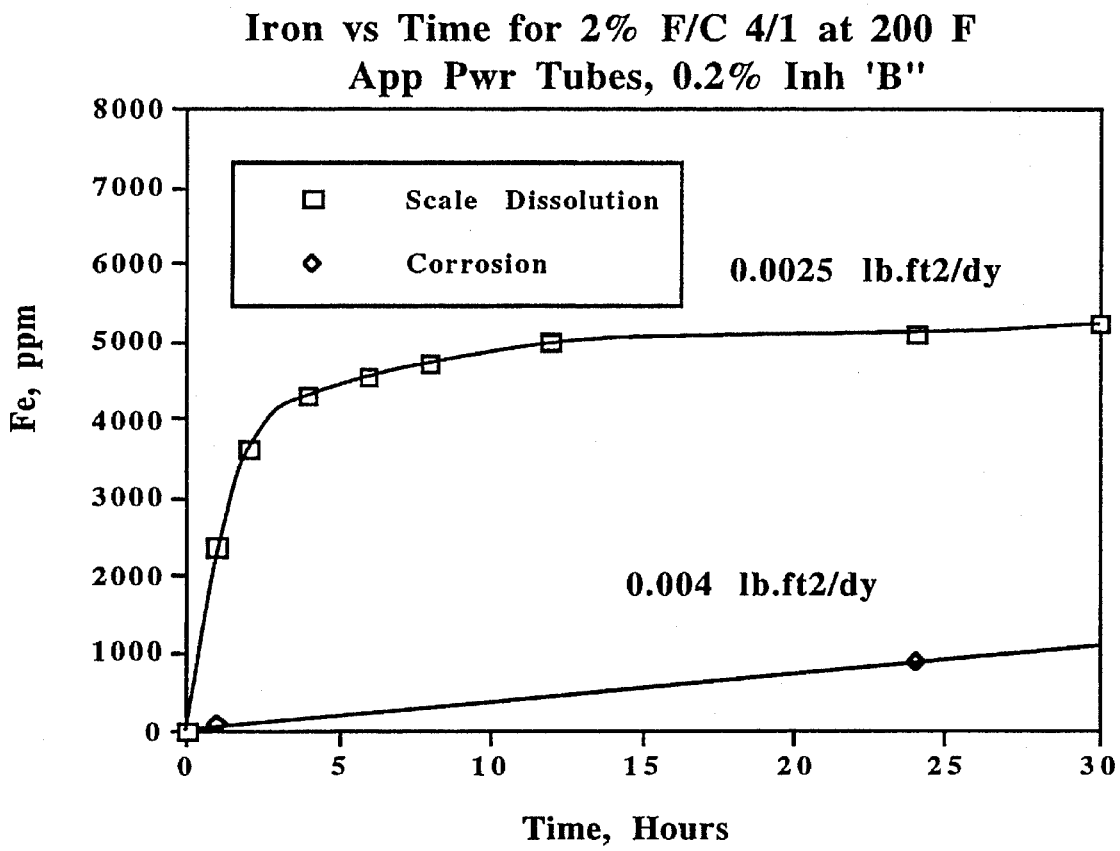

FIGS. 2, 3, and 4, respectively, show the results of using a 2.0 percent 4:1 formic acid-citric acid mixture aqueous solutions in the process of the present invention, respectively, at 150° F. using 0.1 percent Inh "B" as inhibitor (FIG. 2), at 200° F. using 0.2 percent Inh "A" as inhibitor (FIG. 3) and at 200° F. using 0.2 percent Inh "B" as inhibitor (FIG. 4). At 200° F., Inh "B" was the inhibitor of choice.

Figure 5:
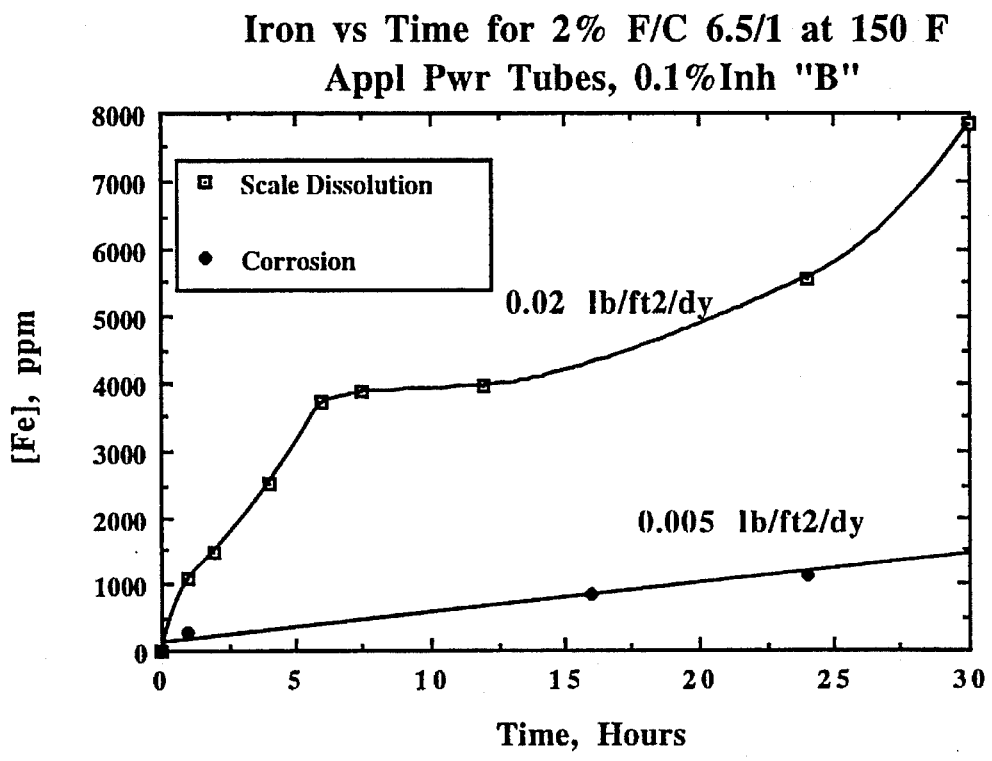
Figure 6:
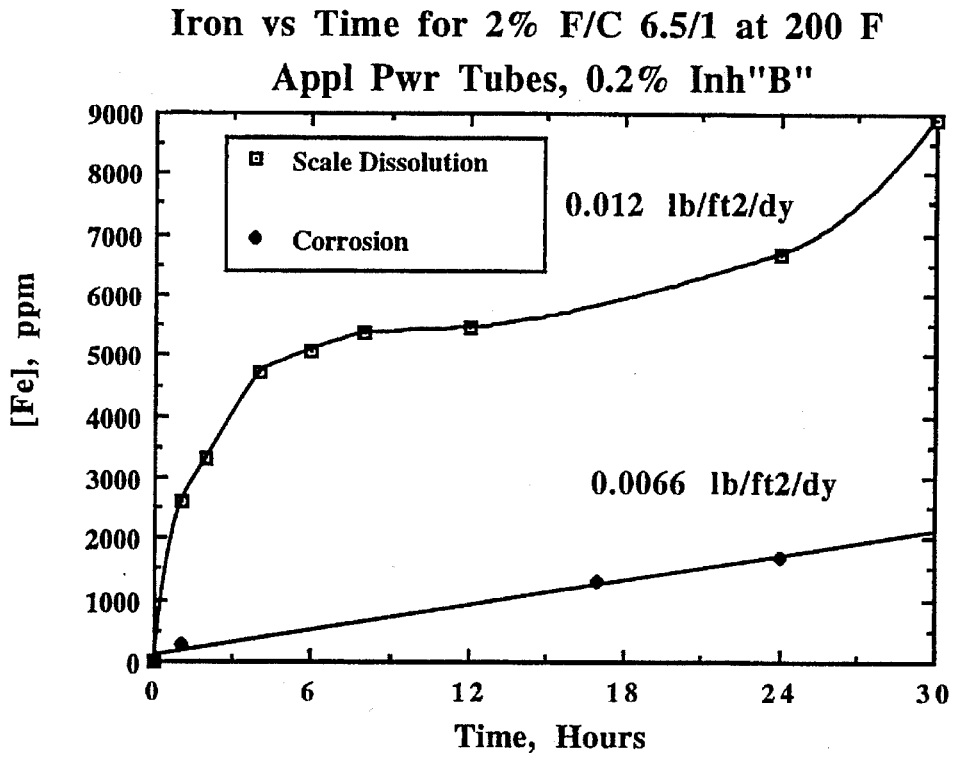

FIGS. 5 and 6, respectively, show the results of using a 2.0 percent 6.5:1 formic acid-citric acid mixture aqueous solutions in the process of the present invention, respectively, at 150° F. using 0.1 percent Inh "B" as inhibitor and at 200° F. using 0.2 percent Inh "B" as inhibitor.

Figure 7:
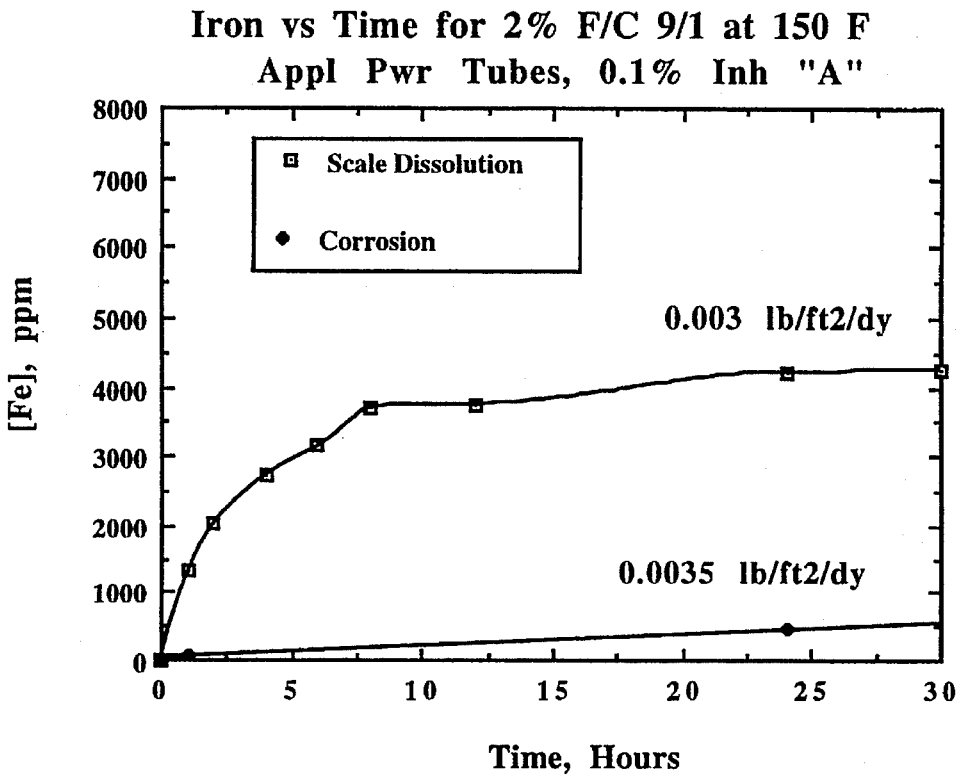
Figure 8:
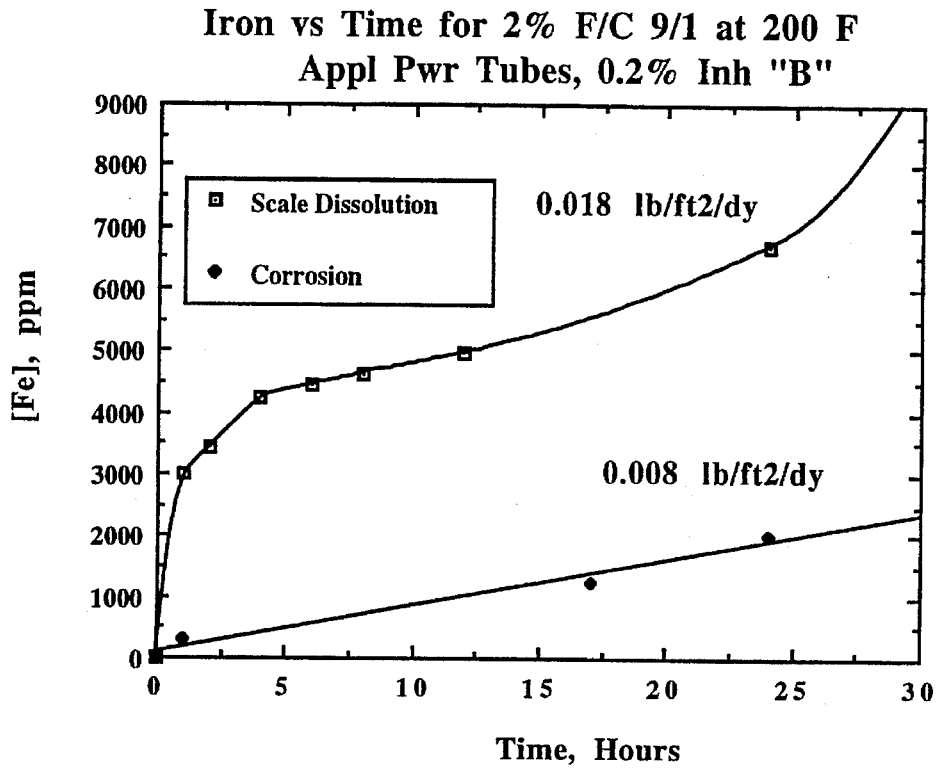
Figure 9:
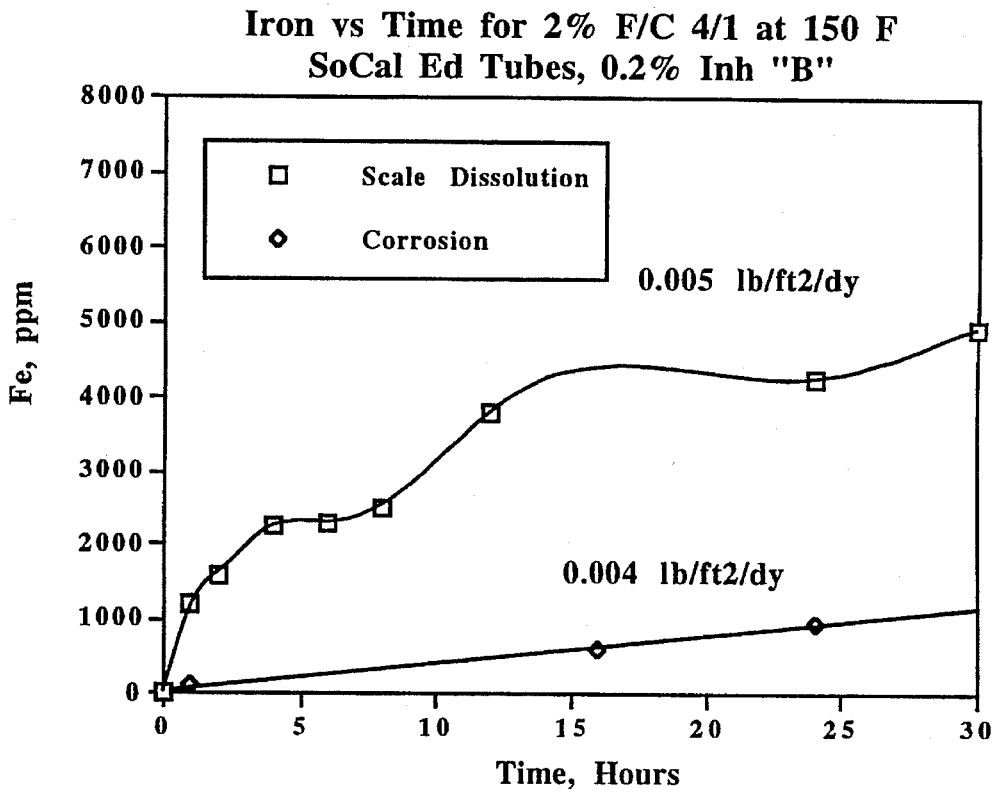
Figure 10:
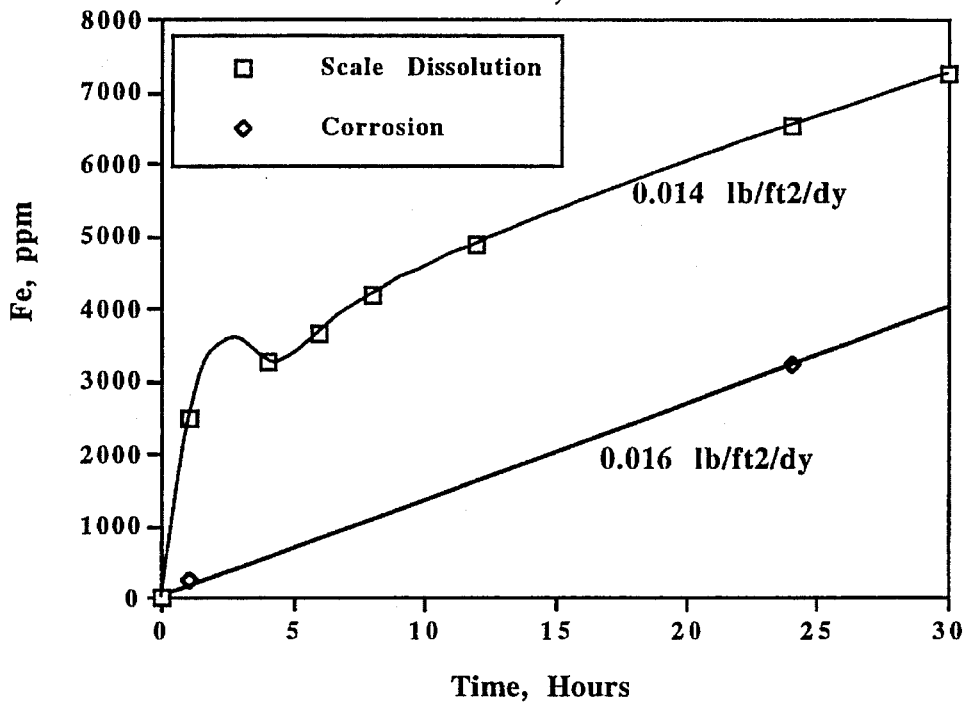
Figure 11:
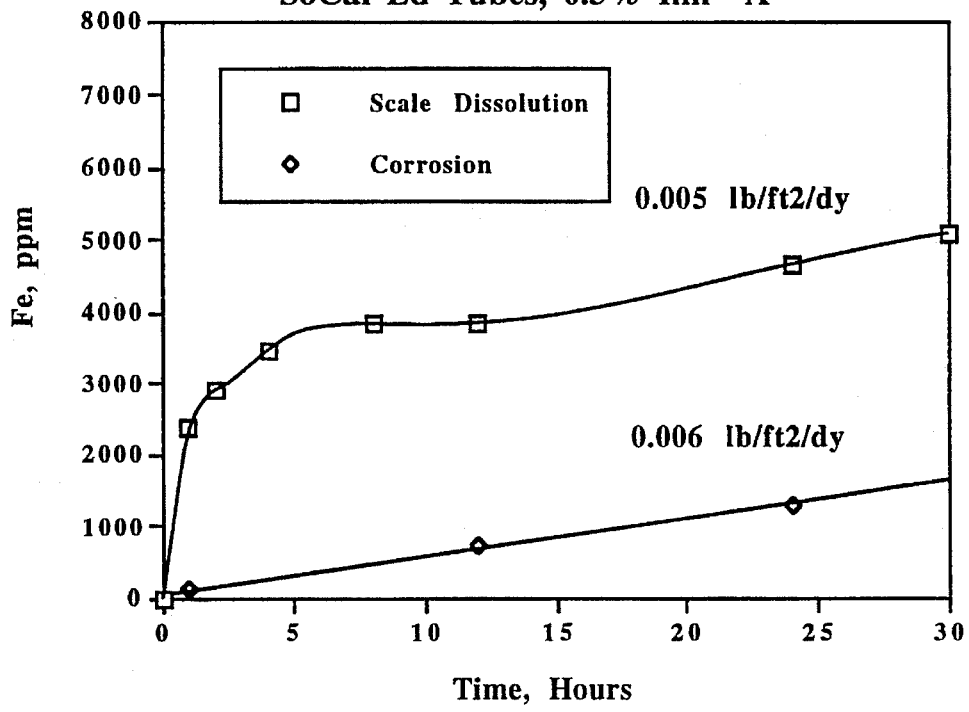
Figure 12:
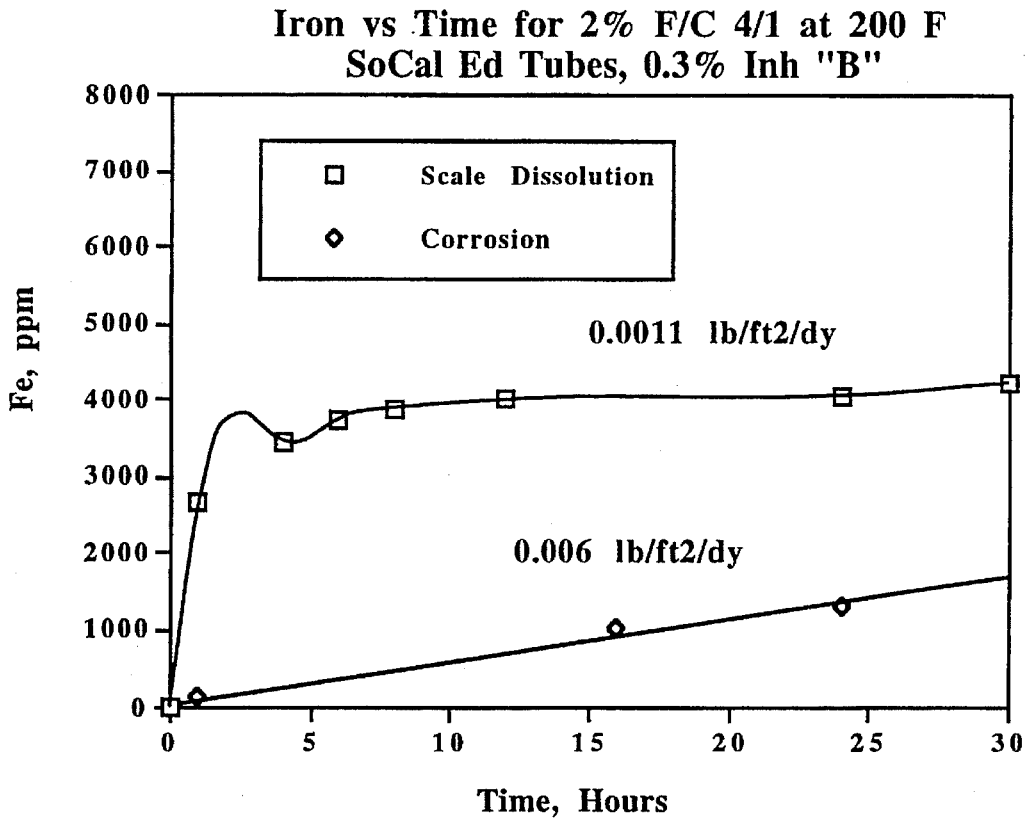

FIGS. 7 and 8, respectively, show the results of using a 2.0 percent 9:1 formic acid-citric acid mixture aqueous solutions in the process of the present invention, respectively, at 150° F. using 0.1 percent Inh "A" as inhibitor and at 200° F. using 0.2 percent Inh "B" as inhibitor.

Sample Set 2

For comparative purposes, a 3.0 percent aqueous solution of 2 parts glycolic acid and 1 part formic acid, containing 0.2 percent Inh "B" as a corrosion inhibitor, at 200° F. was found to clean these tube rings. This amount of inhibitor was insufficient (corrosion rate estimated at 0.024 lb/ft$^2$/day), making it impossible to determine an endpoint for scale removal. Accordingly, retesting was done, with the amount of inhibitor raised to 0.3 percent, which gave a lower corrosion rate and an estimated cleaning time of 10 hours.

Also, for comparative purposes, a 2.0 percent aqueous solution of 2 parts formic acid and 1 part citric acid, inhibited with 0.2 percent Inh "B" was found to clean these tube rings at 150° F. within 12 hours, with a corrosion rate of 0.003 lb/ft$^2$/day. When inhibited with 0.2 percent Inh "A" the solution cleaned these tube rings at 200° F. within 12 hours with a corrosion rate of 0.018 lb/ft$^2$/day. When inhibited with 0.2 percent Inh "B" the solution cleaned these tube rings at 200° F. within 12 hours with a corrosion rate of 0.014 lb/ft$^2$/day. When inhibited with 0.3 percent Inh "A" the solution cleaned these tube rings at 200° F. within 12 hours. Inhibitor loadings of 0.3 percent at 200° F. and 0.2 percent at 150° F., were required to give well-defined endpoints for the cleaning process, as well as low corrosion rates. The two inhibitors were equally effective.

FIGS. 9–12, respectively, show the results of using 2.0 percent 4:1 formic acid-citric acid mixture aqueous solutions in the process of the present invention, respectively, at 150° F. using 0.2 percent Inh "B" as corrosion inhibitor, at 200° F. using 0.2 percent Inh "A" as corrosion inhibitor, at 200° F. using 0.3 percent Inh "A" as inhibitor, and at 200° F. using 0.3 percent Inh "B" as corrosion inhibitor.

Figure 13:
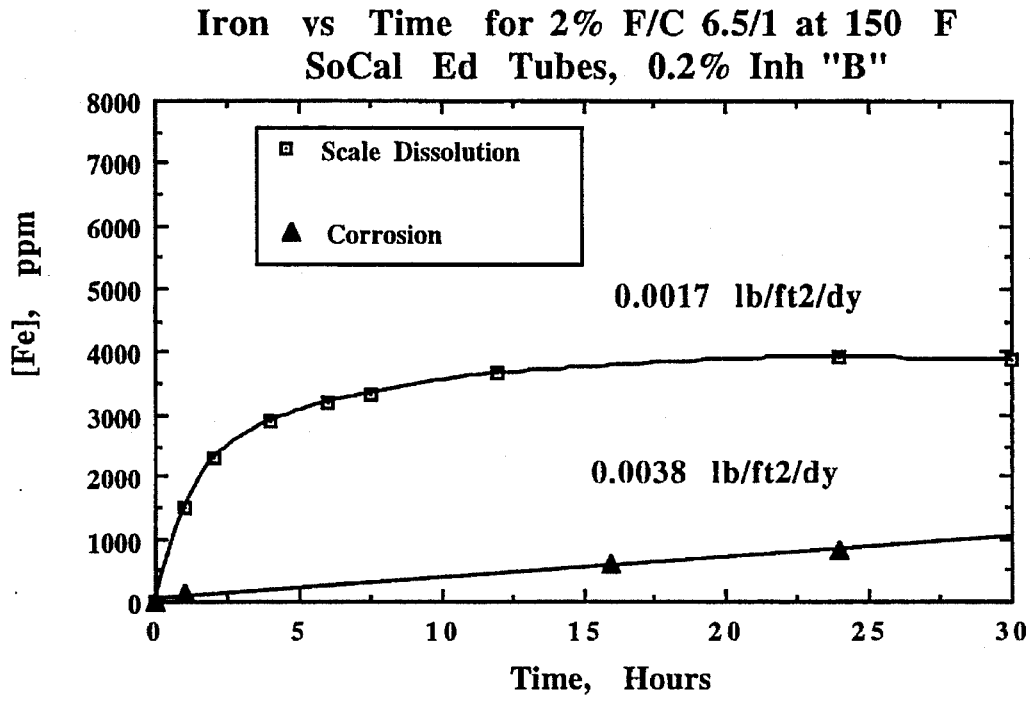
Figure 14:
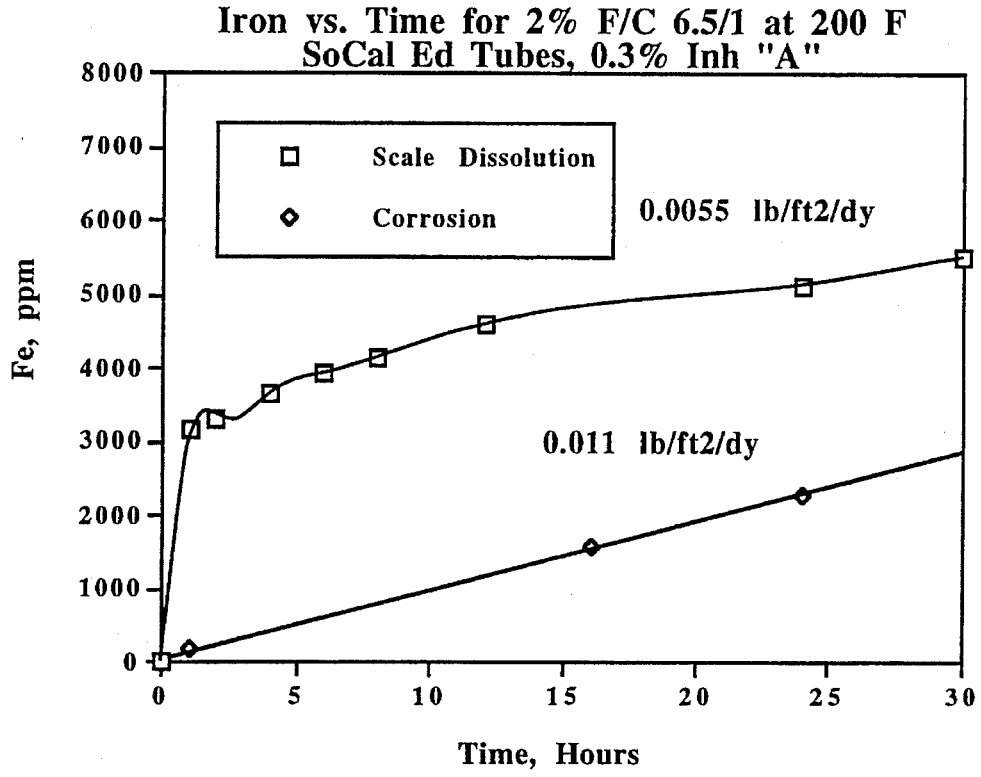
Figure 15:
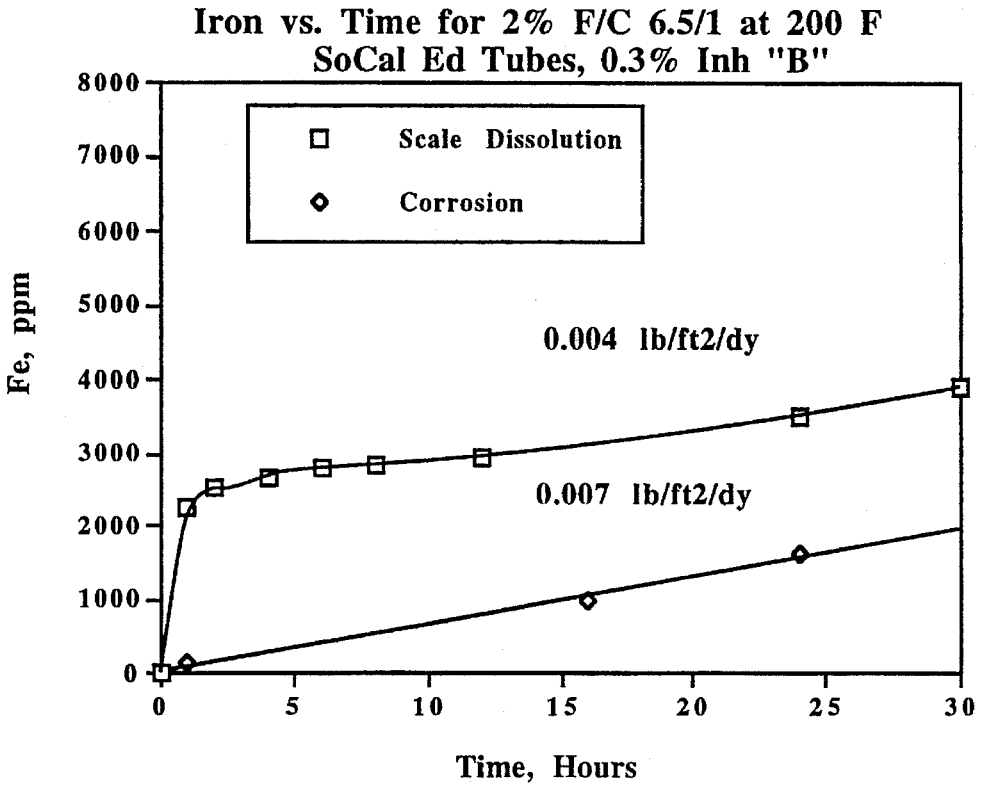

From FIGS. 9–12, it can be seen that, when adequately inhibited (0.2 percent at 150° F. and 0.3 percent at 200° F.), cleaning times of 12 hours at 150° F. and 8 hours at 200° F. are satisfactory, with effectiveness comparable to that of using the inhibited 3.0 percent glycolic-formic acid solution mixture at 200° F. FIGS. 13, 14 and 15, respectively, show the results of using 2.0 percent 6.5:1 formic acid-citric acid mixture aqueous solution in the process of the present invention, respectively, at 150° F. using 0.2 percent Inh "B" as corrosion inhibitor, at 200° F. using 0.3 percent Inh "A" as corrosion inhibitor, and at 200° F. using 0.3 percent Inh "B" as corrosion inhibitor.

Figure 16:
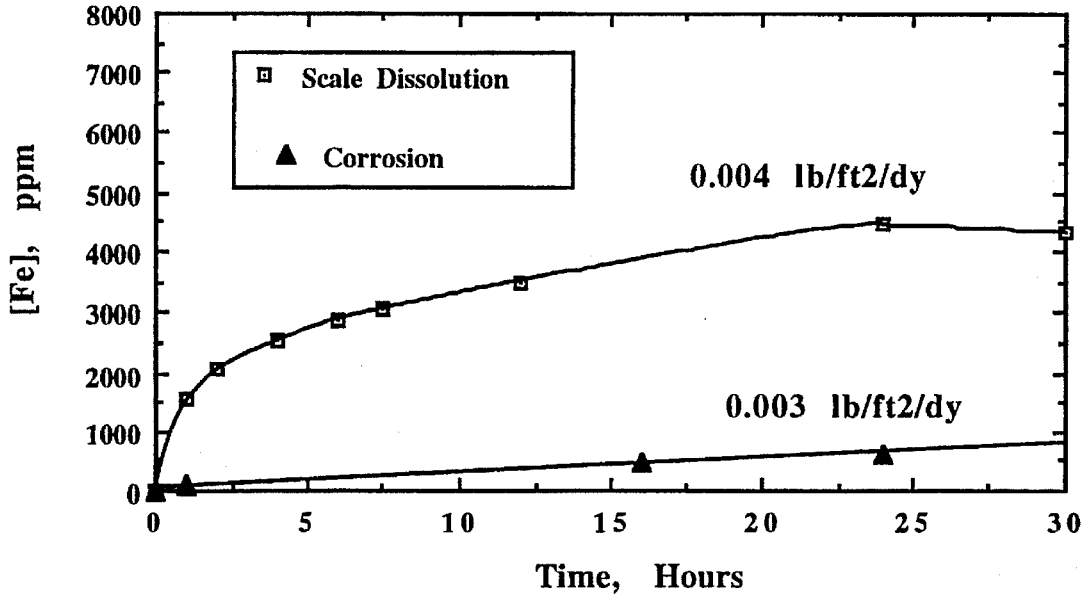
Figure 17:
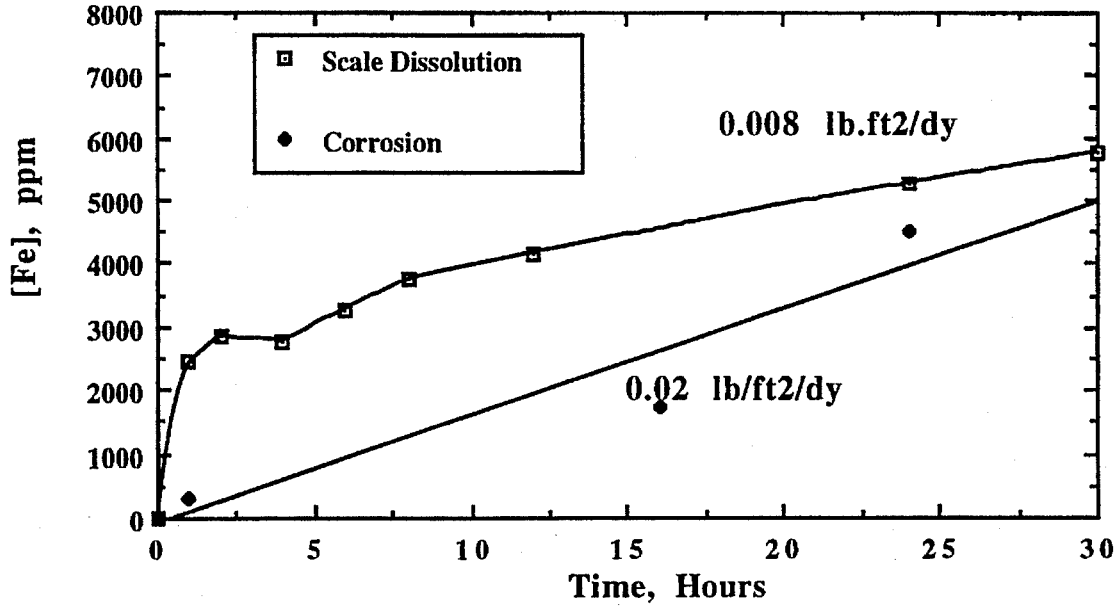
Figure 18:
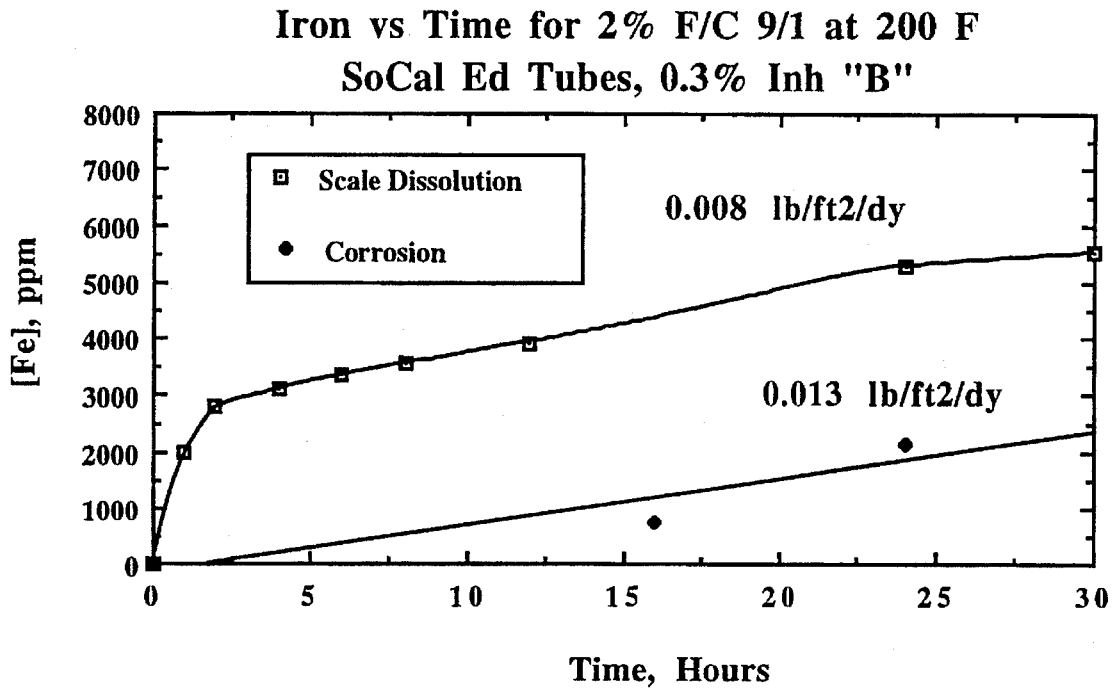

FIGS. 16, 17 and 18, respectively, show the results of using 2.0 percent 9:1 formic acid-citric acid mixture aqueous solutions in the process of the present invention, respectively, at 150° F. using 0.2 percent Inh "B" as corrosion inhibitor, at 200° F. using 0.3 percent Inh "A" as corrosion inhibitor, and at 200° F. using 0.3 percent Inh "B" as corrosion inhibitor.

All of the solvent solutions of FIGS. 13–18 cleaned the tube ring samples, with cleaning times of 12 hours at 150° F. and 6 to 8 hours at 200° F. Necessary inhibitor loadings were 0.1 percent higher than for sample sets 1 and 3, due to the greater chromium in sample set 2.

Sample Set 3

For comparative purposes, a 3.0 percent aqueous solution of 2 parts glycolic acid and 1 part formic acid containing 0.2 percent Inh "B" as a corrosion inhibitor was found to clean these tube rings within 8 hours at 200° F.

Also, for comparative purposes, a 2.0 percent aqueous solution of 2 parts formic acid and 1 part citric acid containing 0.1 percent Inh "B" as a corrosion inhibitor was found to clean these tube rings within 12 hours at 150° F., and containing 0.2 percent Inh "B" as a corrosion inhibitor, was found to clean these tube rings within 6 hours at 200° F.

Figure 19:
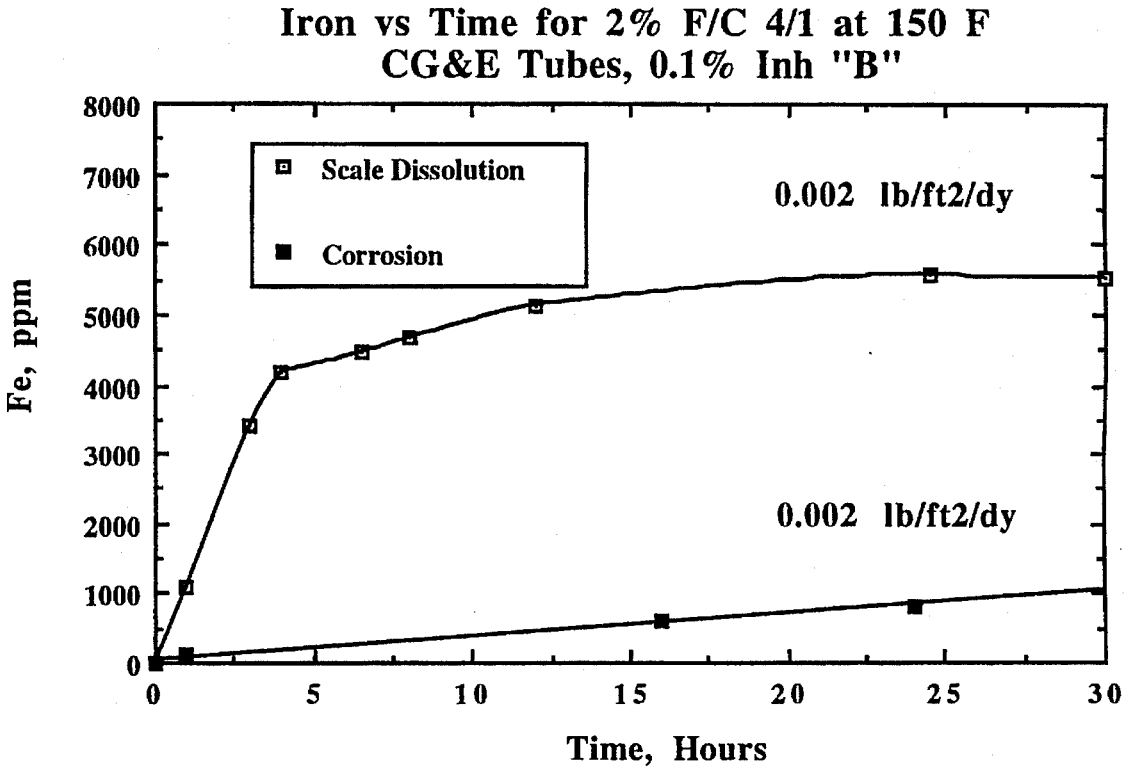
Figure 20:
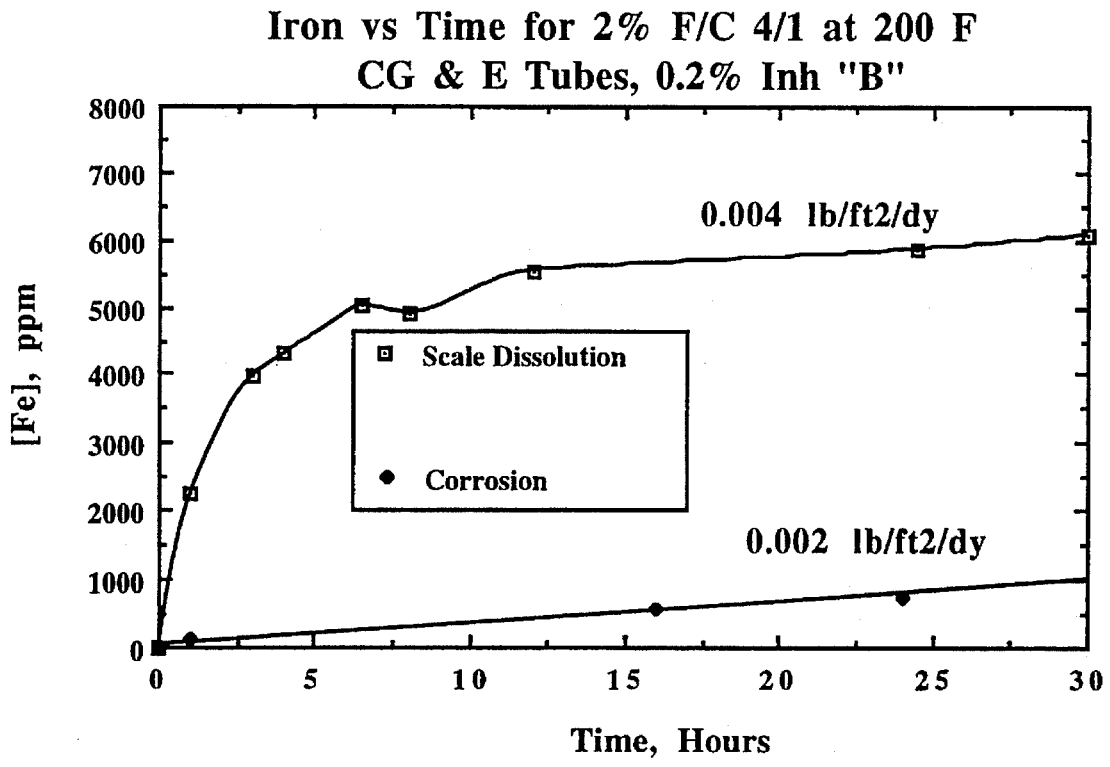

FIGS. 19 and 20, respectively, show the results of using 2.0 percent 4:1 formic acid-citric acid mixture aqueous solutions in the process of the present invention, respectively, at 150° F. using 0.1 percent Inh "B" as corrosion inhibitor, and at 200° F. using 0.2 percent Inh "B" as corrosion inhibitor. Respective cleaning times were 12 hours and 6 hours.

Figure 21:
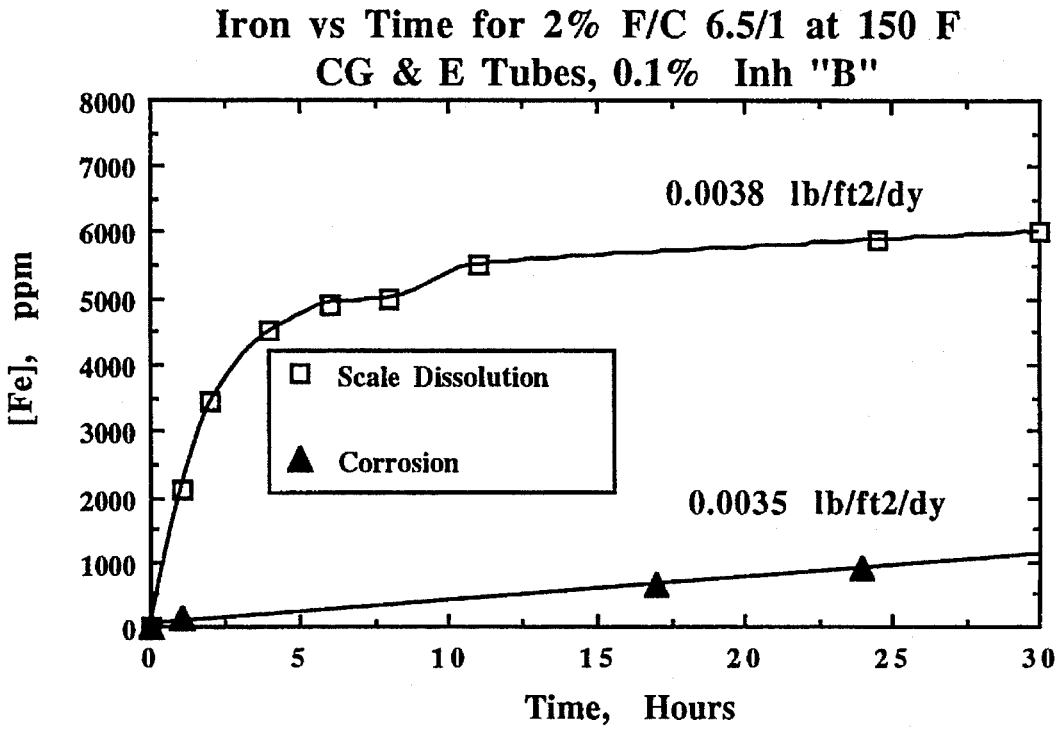
Figure 22:
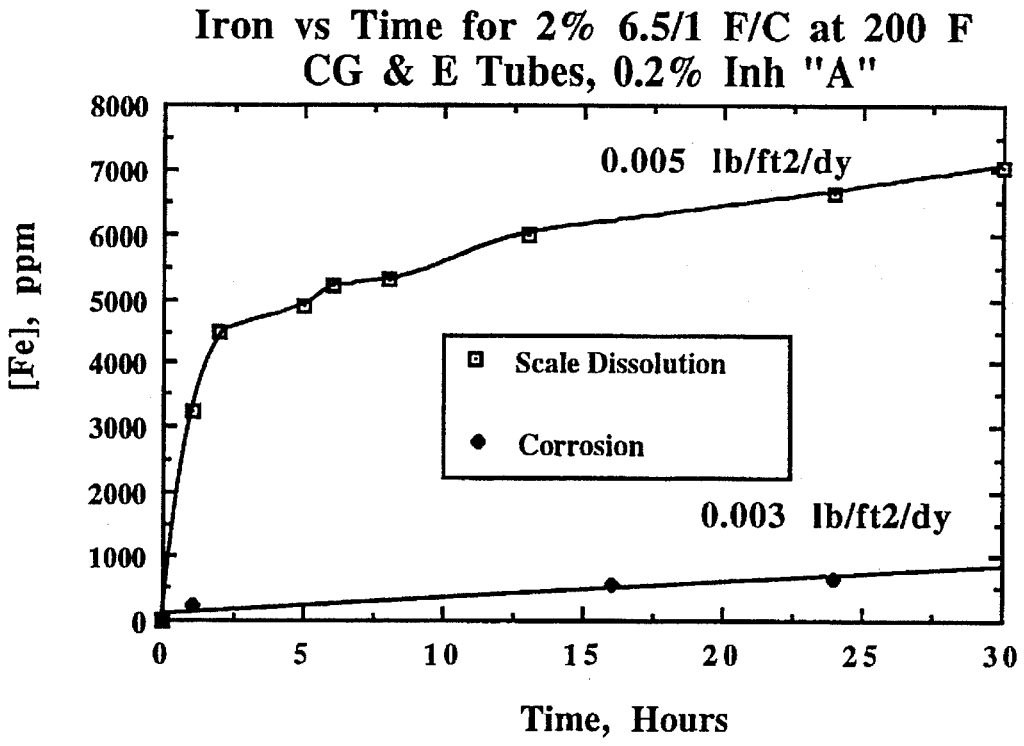
Figure 23:
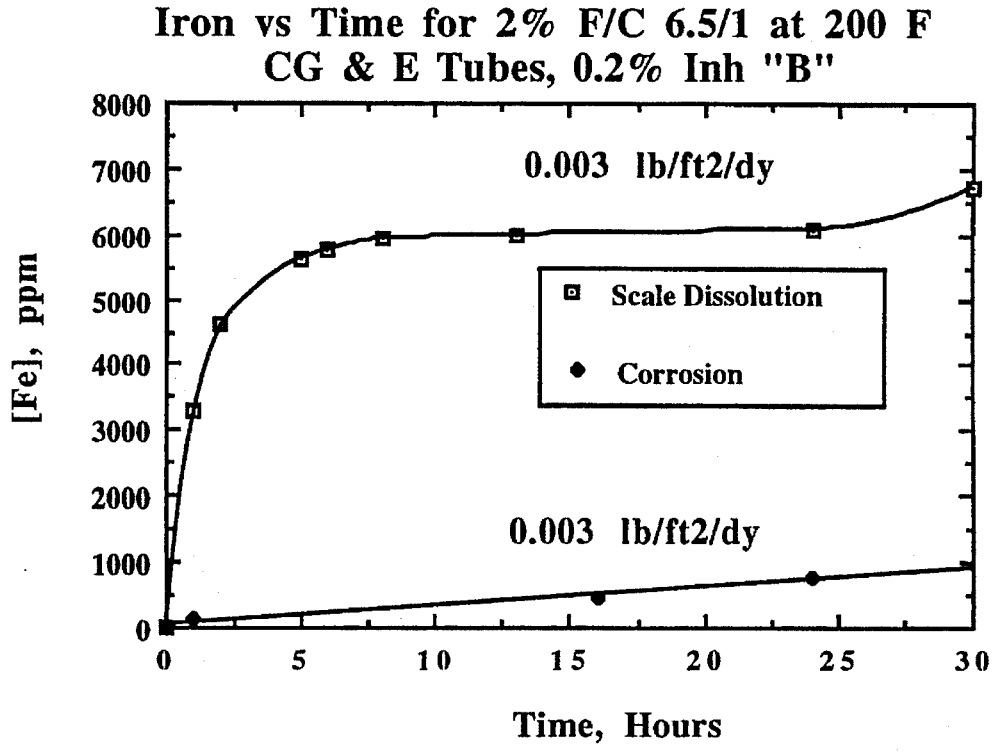

FIGS. 21–23, respectively, show the results of using 2.0 percent 6.5:1 formic acid-citric acid mixture aqueous solutions in the process of the present invention, respectively, at 150° F. using 0.1 percent Inh "B" as corrosion inhibitor, at 200° F. using 0.2 percent Inh "A" as corrosion inhibitor, and at 200° F. using 0.2 percent Inh "B" as corrosion inhibitor. Respective cleaning times were 10 hours, 6 hours and 6 hours.

Figure 24:
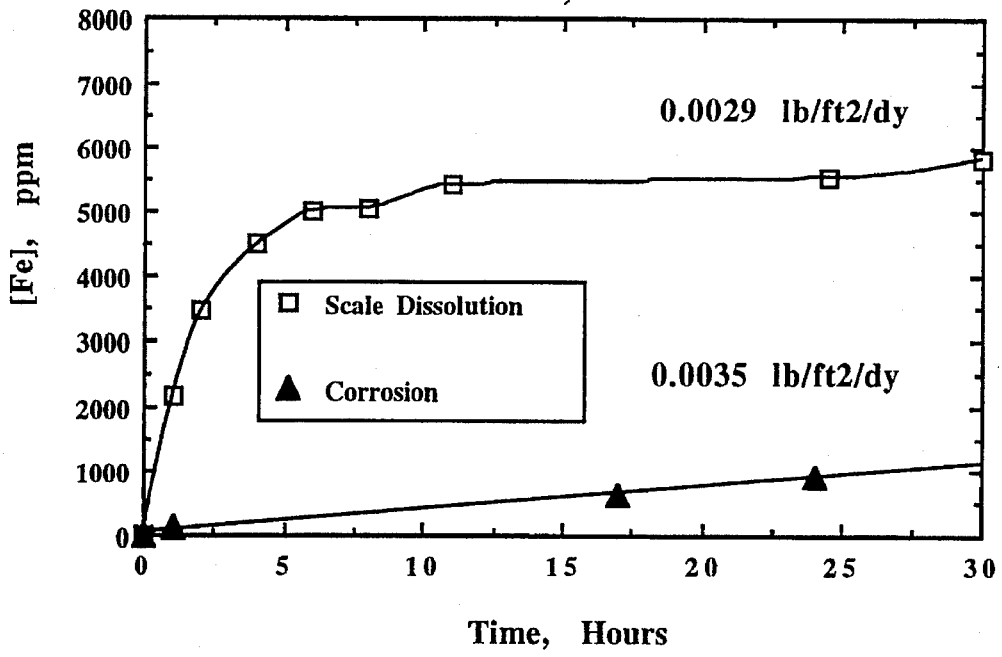
Figure 25:
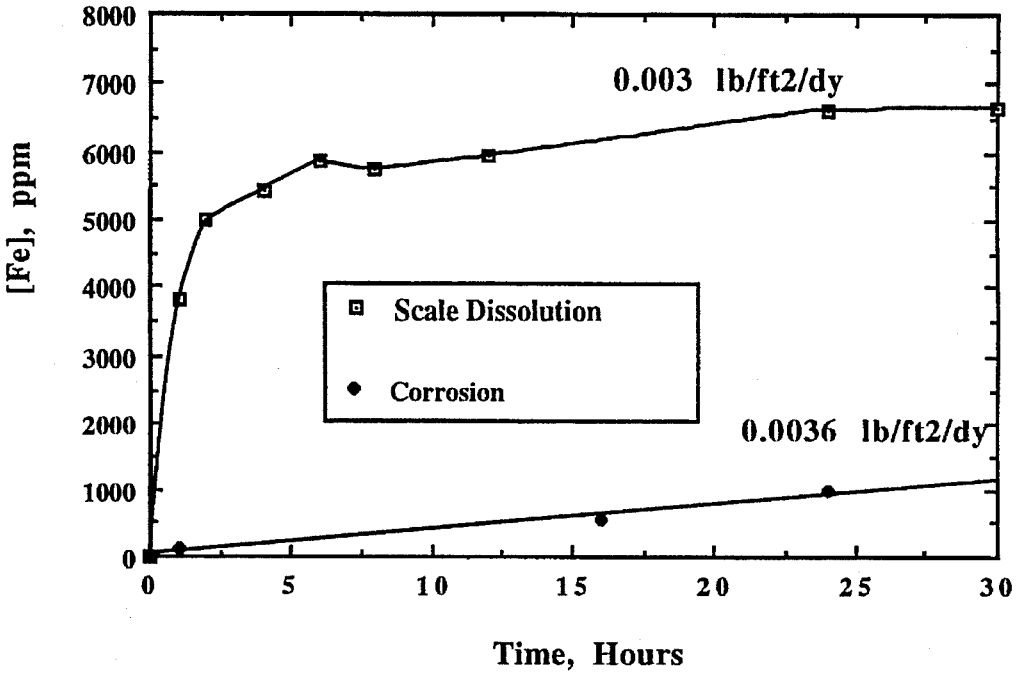
Figure 26:
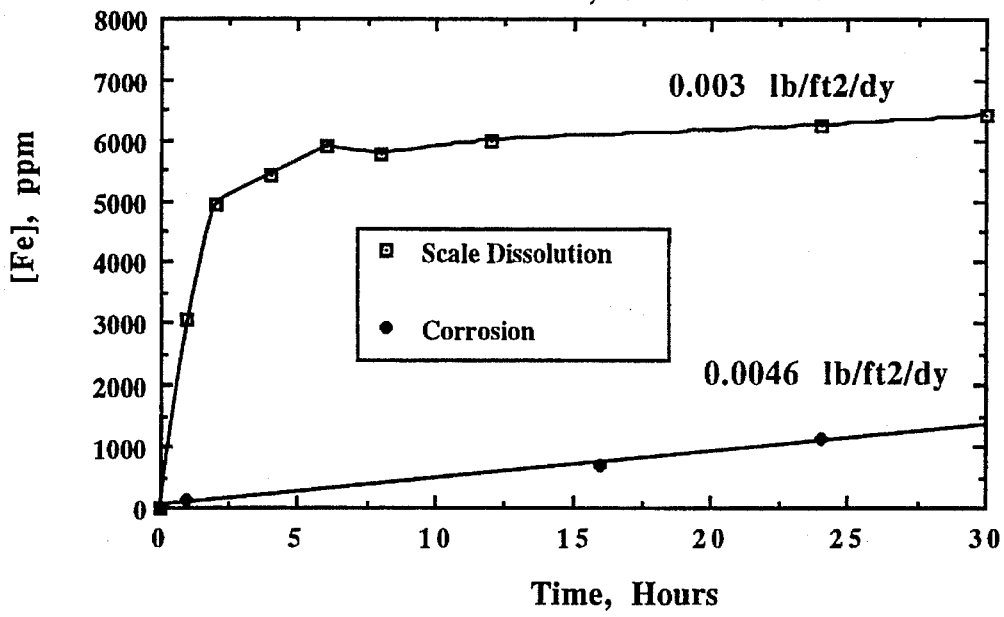
Figure 27:
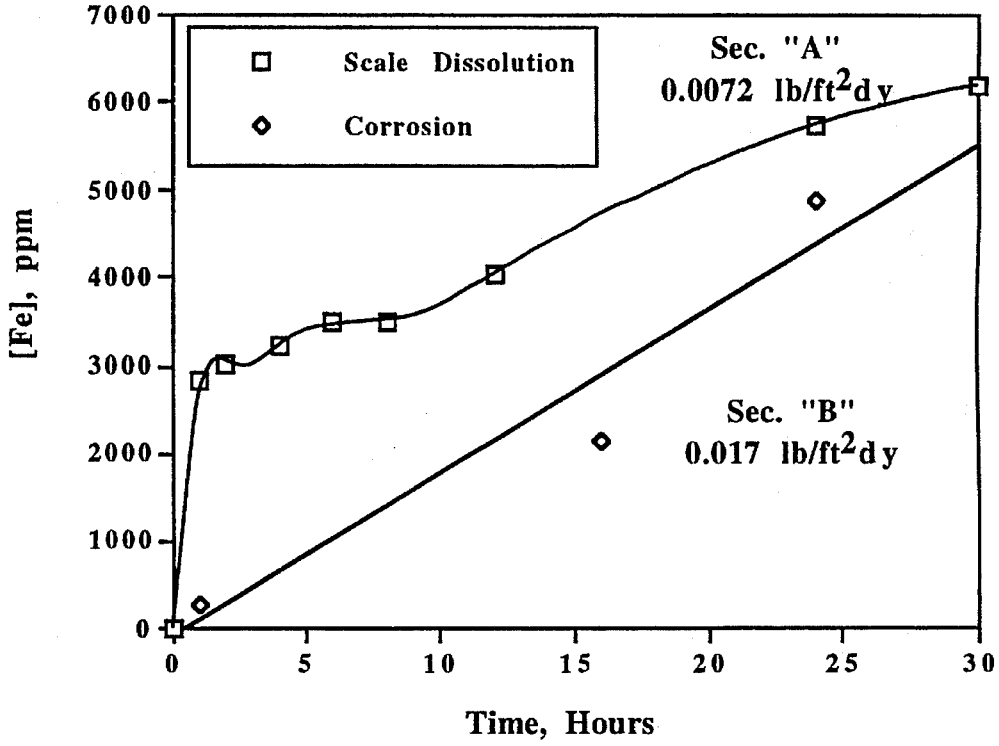
FIGS. 27–38 are graphical illustrations of the results of tests of removal of magnetite from the internal surfaces of drumless boilers using aqueous solutions of formic acid and a variety of higher organic acids at a weight ratio of 4:1 in processes in accord with the present invention.
Figure 28:
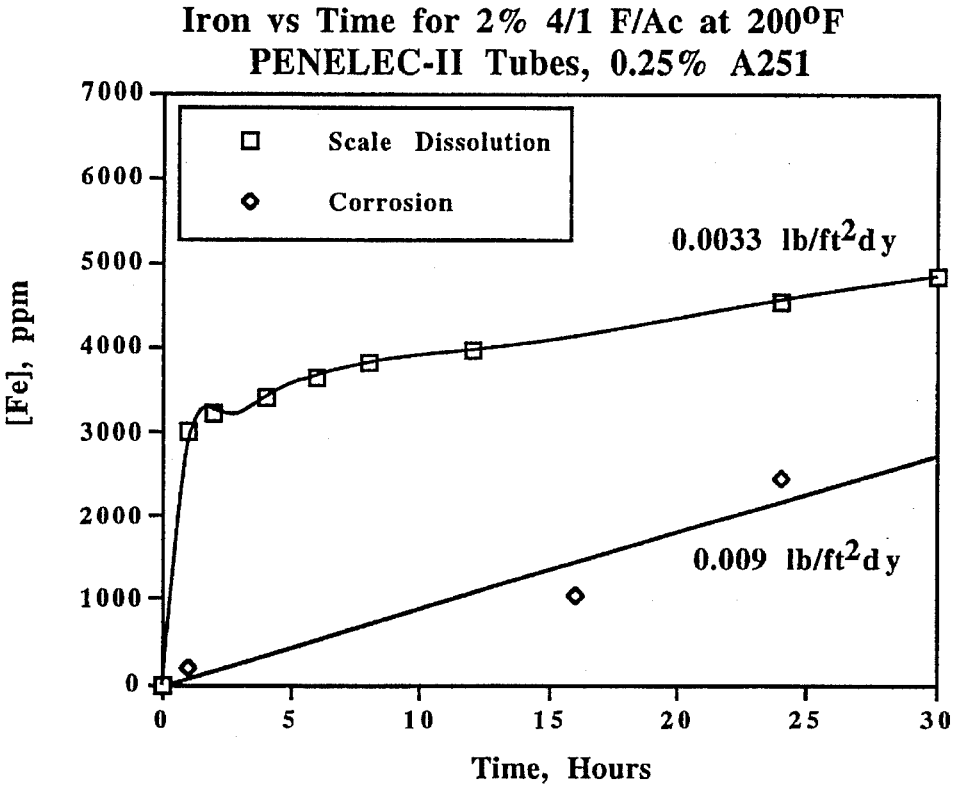
Figure 29:
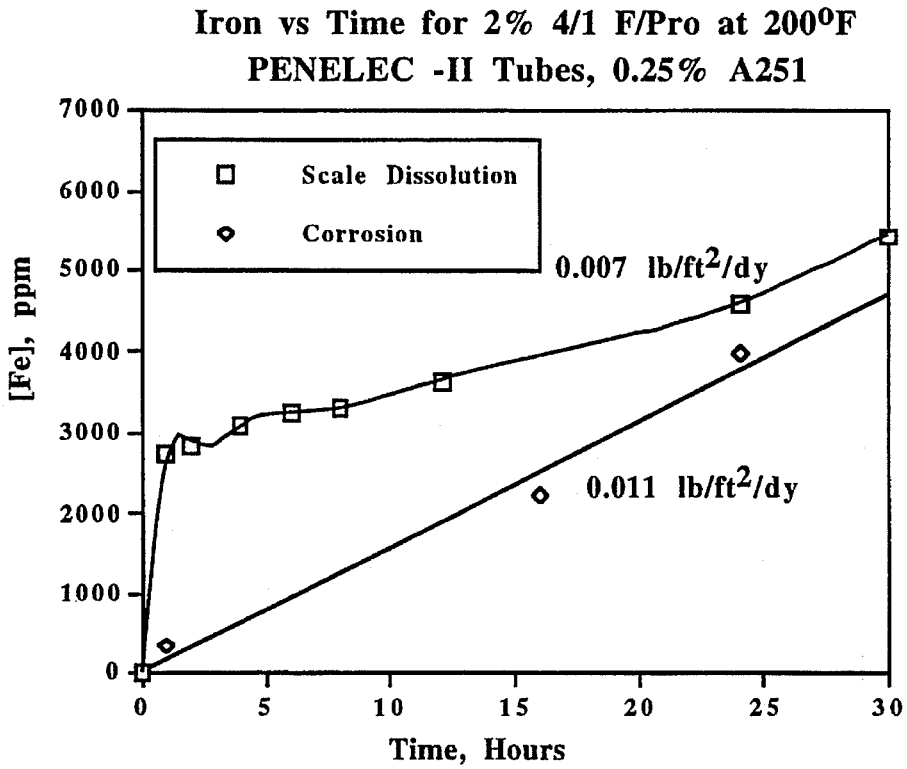
Figure 30:
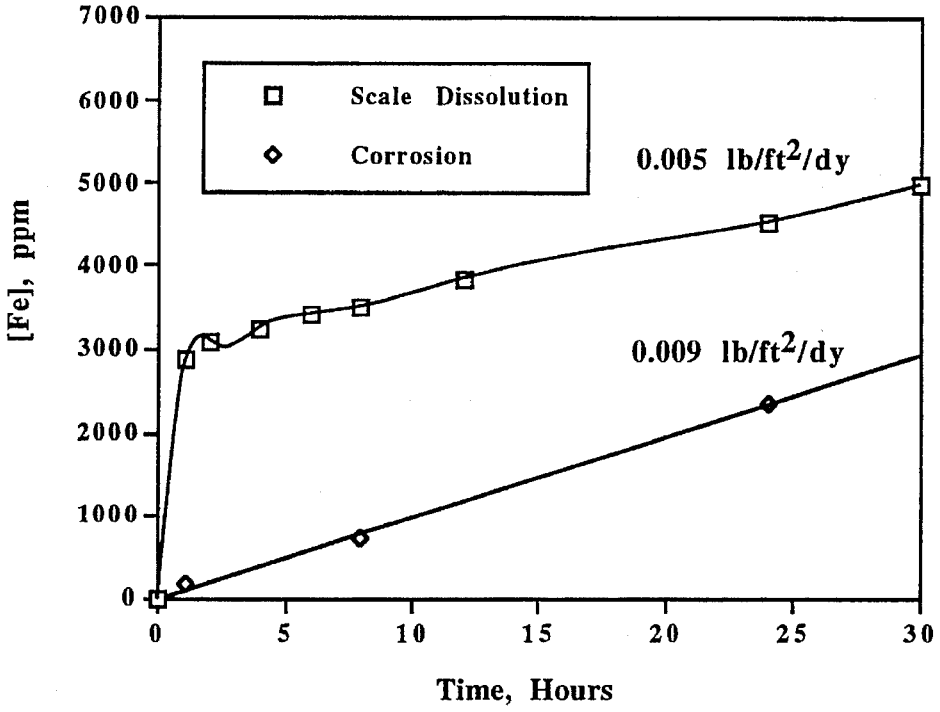
Figure 31:
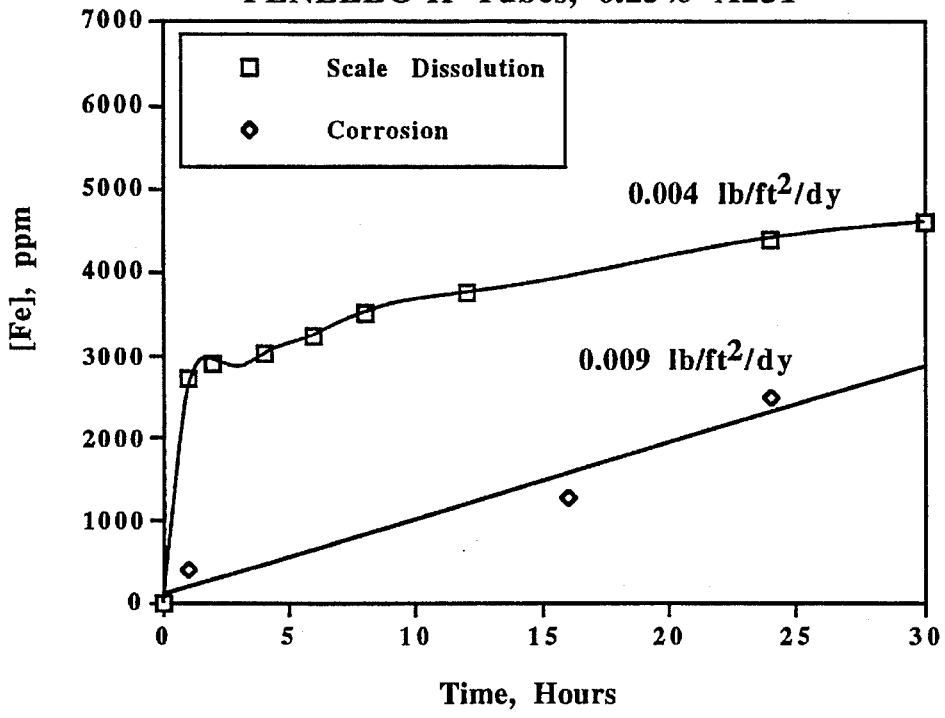
Figure 32:
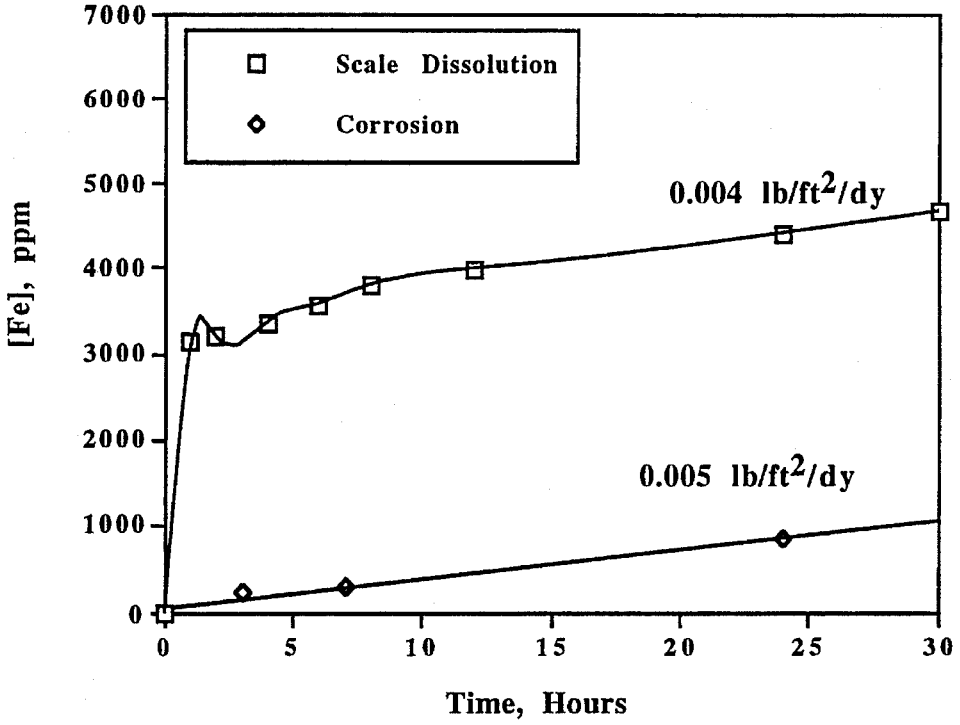
Figure 33:
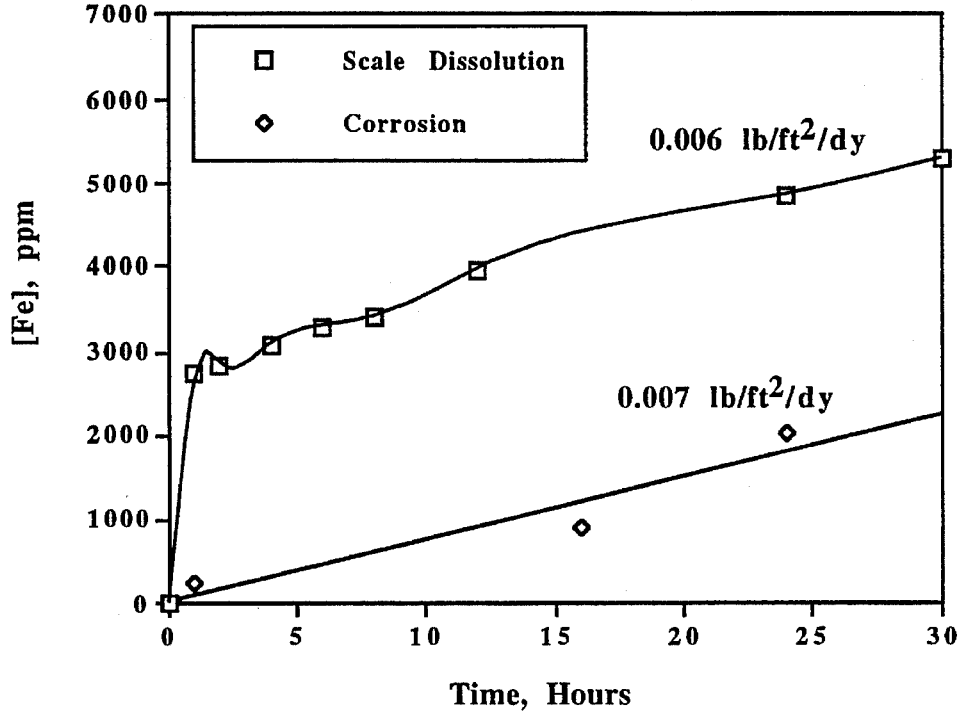
Figure 34:
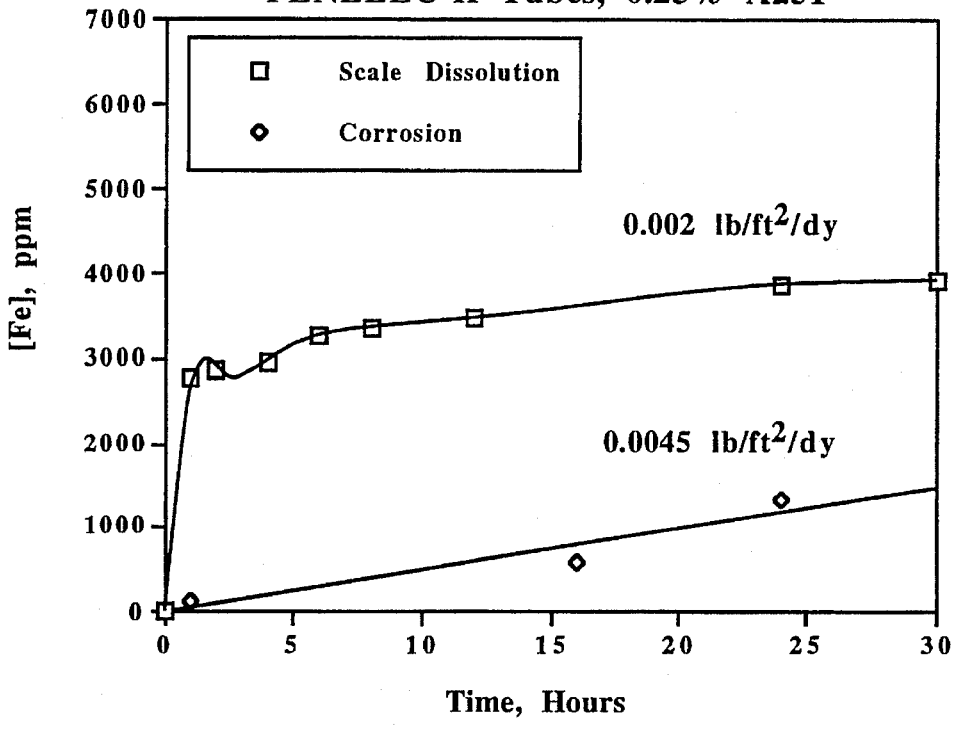
Figure 35:
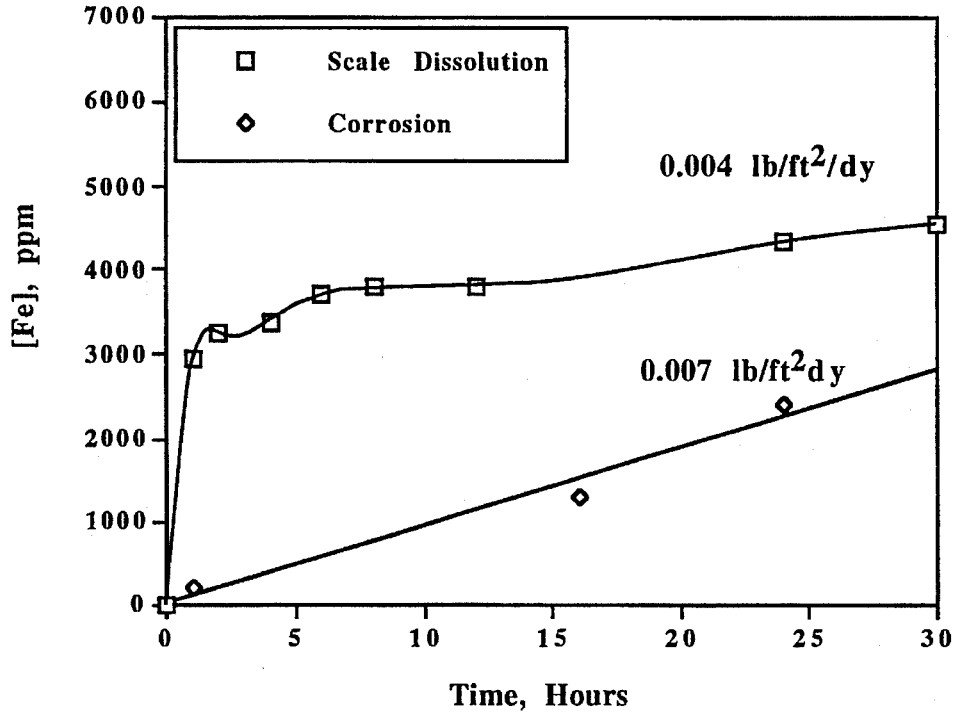
Figure 36:
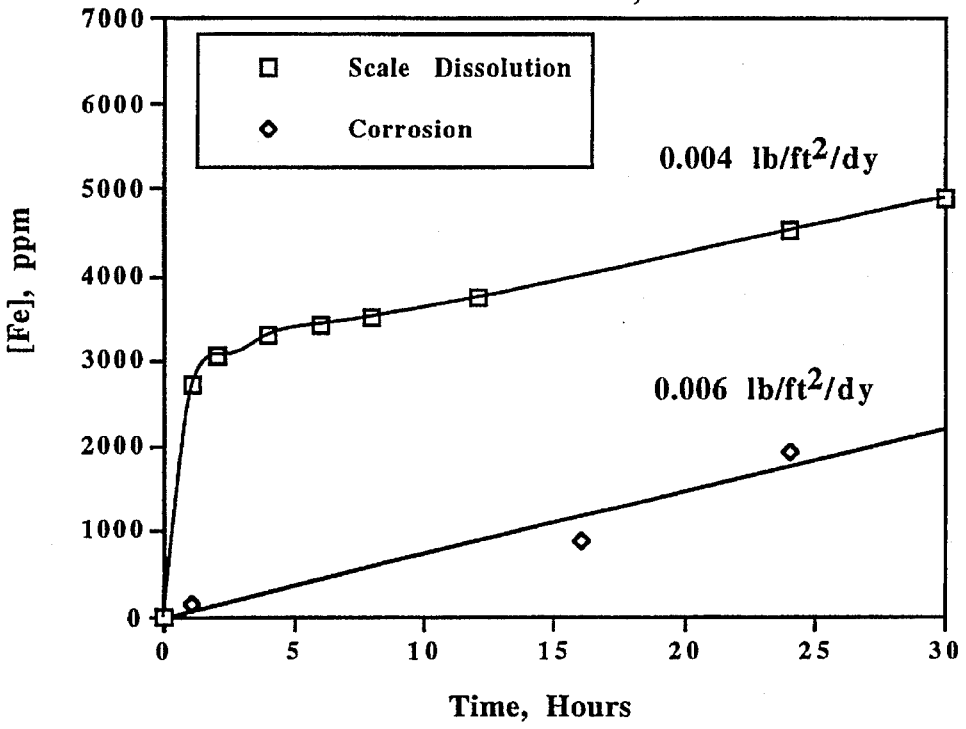
Figure 37:
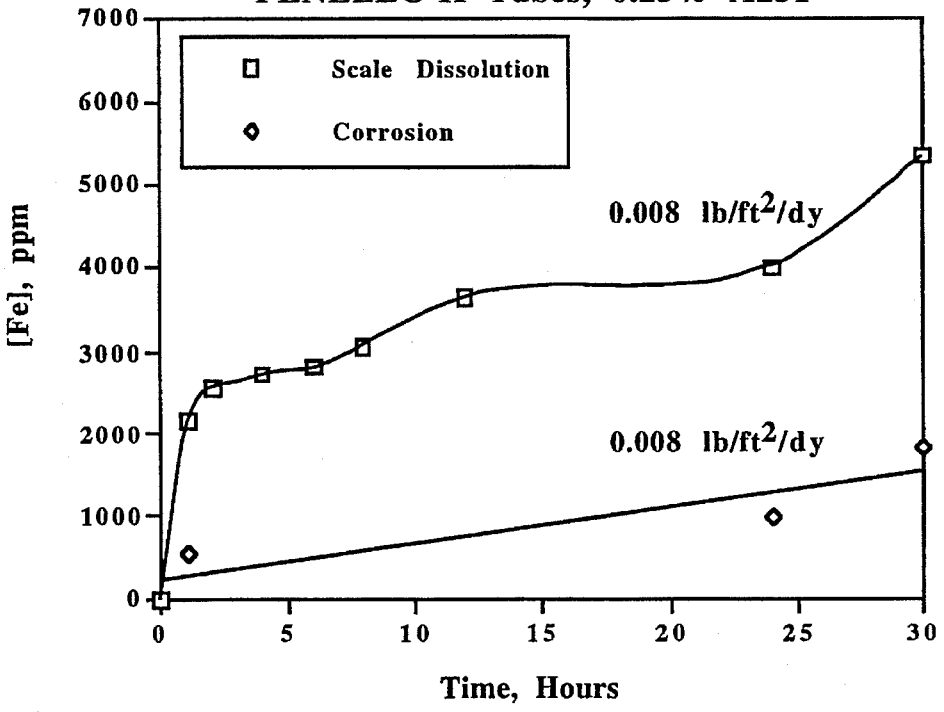
Figure 38:
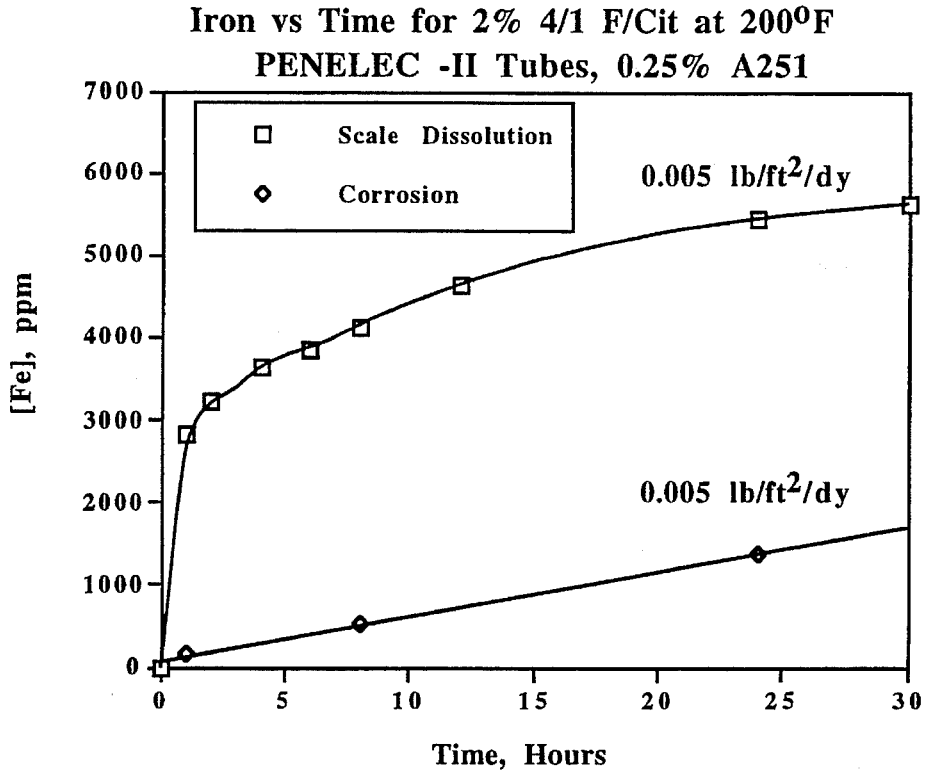

FIGS. 24–26, respectively, show the results of using 2.0 percent 9:1 formic acid-citric acid mixture aqueous solutions in the process of the present invention, respectively, at 150° F. using 0.1 percent Inh "B" as corrosion inhibitor, at 200° F. using 0.2 percent Inh "A" as corrosion inhibitor, and at 200° F. using 0.2 percent Inh "B" as corrosion inhibitor. Respective cleaning times were 8 hours, 6 hours and 6 hours.

Figure 39:
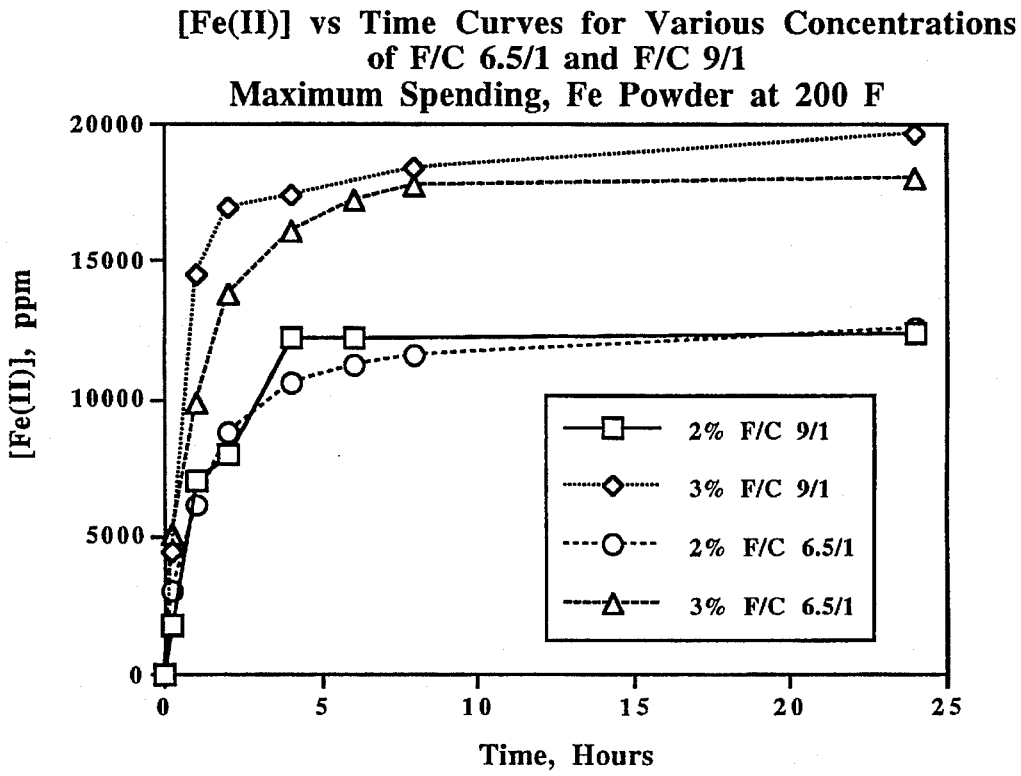
FIG. 39 is a graphical illustration of the capacity of aqueous solutions containing 2 percent and 3 percent formic acid and citric acid mixtures at weight ratios of 6.5:1 and 9:1 to hold iron in the ferrous state, as determined in connection with the present invention, the values shown being in line with the total acidity, i.e., $[H^+]$, of the solvents.
Figure 42:
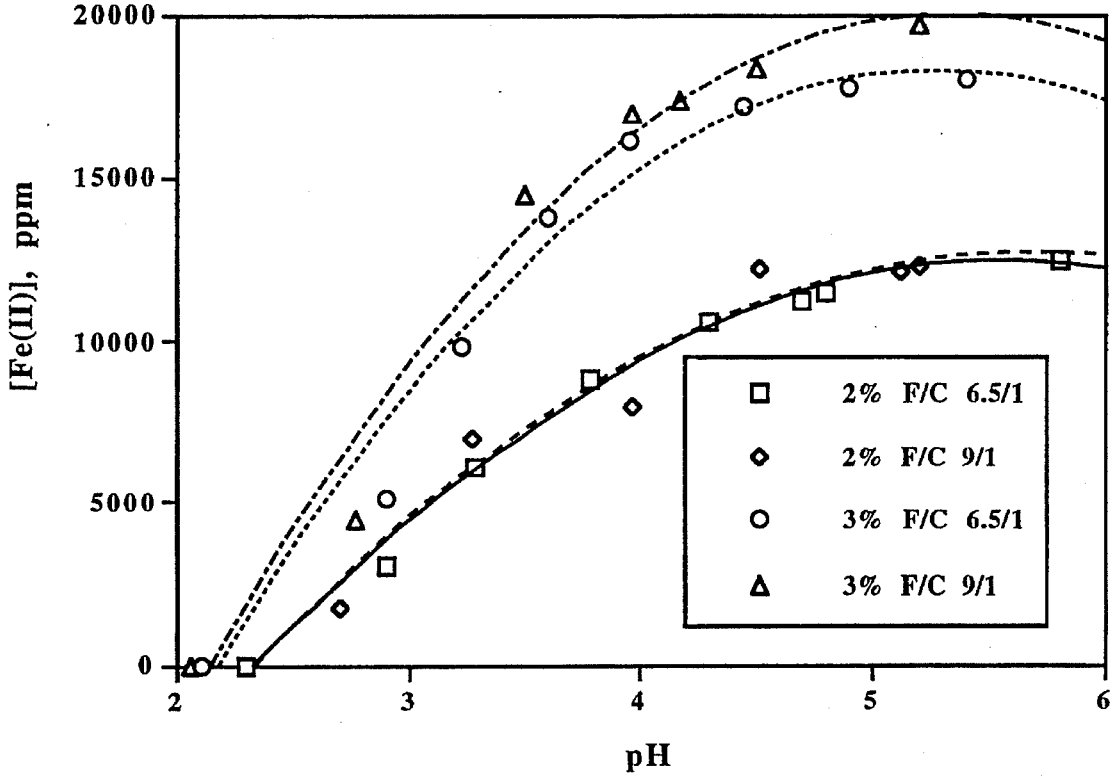
FIGS. 42–45 are graphical illustrations showing the capacity of solvents of the methods of the present invention to hold iron as a function of pH. Note that FIG. 42 relates to ferrous iron, while FIGS. 43–45 relate to ferric iron.

FIG. 39 shows the capacity of 2 percent and 3 percent 6.5:1 and 9:1 formic acid-citric acid mixture aqueous solutions to hold iron in the ferrous state, as determined in connection with the present invention, the values shown being in line with the total acidity (i.e., $[H^+]$) of the solvents. FIG. 42 shows that no precipitation of iron hydroxide or loss of iron concentration from the spent solutions was observed within 24 hours for a pH below 7, in the absence of air.

The present inventor has concluded from the tests that when pH is maintained below 7.0 and air is excluded in a reducing atmosphere, cleaning efficiencies of formic acid-citric acid mixtures in aqueous solution in a proportion range of between 4:1 and 9:1 are essentially the same as for 3 percent 2:1 aqueous solutions of glycolic acid and formic acid, and essentially the same as for the 2:1 aqueous solutions of formic acid-citric acid of the Reich patent with the exception of the higher rate for the 4:1 aqueous solution in sample set 1. The potential savings in inhibitor costs when cleaning at lower temperatures needs to be balanced against the cost of increased time at the job site for particular practices of the process. At present prices, cost savings based on chemicals used in 3 percent mixed glycolic and formic acid solutions, and 2 percent mixed formic acid and citric acid solutions can be about 40 percent. Further, the oxidation step that is needed for removing metals from the spent cleaning solution in the former instance may be avoided in the latter.

The formic acid-citric acid ratio of 4:1 was acceptable for all three sample sets, whereas the ratio of 6.5:1 was fully acceptable for two of the three, and the ratio of 9:1 for one of the three. Corrosion rates were above the target 0.015 $lb/ft^2/day$.

Conventional waste treatment methods (lime, caustic and air) reduced concentrations of iron, chromium and nickel in the spent cleaning solution to below 1 ppm.

The test results suggest that at least when Inh "B" is used as the corrosion inhibitor, the citric acid in the cleaning solution functions, in part, as an inhibitor aid.

The test results have demonstrated that 2.0 percent aqueous solutions of 4:1 formic acid to citric acid will hold more than 0.7 percent ferrous iron; proportionately higher concentrations of the acid mixture will hold at least 1.5 percent ferrous iron.

Contrary to the teachings of Reich, formic acid-citric acid ratios in the range of 4:1 to 9:1 were found, under the test conditions, to hold a stoichiometric concentration of iron (in the ferrous state), with insignificant loss of iron from solution over at least 24 hours.

Additional tests were performed to investigate higher acid ratios for use in the processes of the present invention. Static corrosion tests using mixtures of formic acid containing various amounts of DL-malic acid were conducted to investigate the effects of higher formic to carboxylic acid ratios. The procedures described above were used. The SA-213-T22 (2¼% Cr) coupons were placed into enough of the solvent to give a surface/volume ratio of 0.6/cm. All of the solutions contained 2.0 percent-by-weight total organic acid and 0.1 percent Inh "A" as the corrosion inhibitor. The solutions with the inhibitor and coupons were heated at 200° F. in closed bombs that had been immersed in an oil bath. At the end of the 16 hour test, the coupons were removed, cleaned, weighed and a corrosion rate ($lb/ft^2/day$) was calculated. The presence of pits also was noted. The results are seen below in Table I.

TABLE I

Static Corrosion Rates for SA-213-T22
2% Organic Acid Mixture and 0.1% Inh. B, 200° F.

| Formic/Malic Ratio (wt/wt) | Corrosion Rate ($lb/ft^2/day$) | Pitting |
|---|---|---|
| 4/1 | 0.006 | Slight |
| 10/1 | 0.010 | Moderate |
| 15/1 | 0.011 | Moderate |
| 20/1 | 0.009 | Moderate–Heavy |
| Formic Acid (0% Malic Acid) | 0.022 | Heavy |

The corrosion rates were acceptable, i.e., less than 0.015 $lb/ft^2/day$, for all of the mixed acids. However, the pitting became increasingly unacceptable at higher ratios. Neither the corrosion rate nor the pitting was acceptable with straight formic acid. Tests were conducted to investigate the acceptability of a variety of carboxylic acids in the methods of the present invention. Static corrosion tests were conducted using 300 ml stainless steel bombs which were placed in a silicone oil bath maintained at 200° F. A single coupon of SA-213-T-22 (2-¼% Cr) was placed in a glass liner that was then placed in the bomb for 16 hours. The surface/volume ratio was 0.6/cm. The results of these tests for cleaning solutions having a variety of formic acid-carboxylic acid mixtures are listed below in Table II.

TABLE II

| Acid | Corrosion Rate $lb/ft^2/day$ A | B |
|---|---|---|
| Formic | 0.009 | 0.011 |
| Acetic | 0.008 | 0.008 |
| Glyoxylic | | 0.047 |
| Propionic | | |
| Glycolic | 0.008 | 0.009 |
| Glycine | 0.008 | 0.009 |
| Oxalic | | 0.025 |
| Thioglycolic (Mercaptoacetic) | 0.008 | 0.009 |
| Lactic | 0.006 | 0.006 |
| Malonic | 0.007 | 0.005 |
| Maleic | | 0.019 |
| Fumaric | 0.006 | 0.006 |
| Succinic | 0.006 | 0.005 |
| Glutaric | 0.005 | 0.005 |
| Malic | 0.007 | 0.007 |
| Tartaric | 0.006 | 0.008 |
| Ascorbic | | 0.009 |
| Citric | 0.006 | 0.006 |
| Gluconic | | 0.010 |
| HEDTA | | 0.032 |

A-Static test: 2¼ Cr, 200° F., 0.29 m Formic Acid/0.034 m Carboxylic Acid, 0.1% Inh "B"
B-Static test: 2¼ Cr, 200° F., 2% 2/1 Formic Acid/Carboxylic Acid, 0.1% Inh "B"

The eleven acids (plus formic acid) that gave the lowest corrosion rates in the static tests, were used at a 4/1 weight ratio to clean sections of the PENELEC-II tubes.. Dynamic Parr bomb tests were conducted in the manner described above. In each test, four boiler tube rings from Pennsylvania Electric Conemaugh Station (PENELEC-II, SA 213-T-22, total S.A 200 $cm^2$) were cleaned. The iron concentration versus time curve was determined using inductively coupled plasma (ICP). After the cleaning section of the test (30 hours), the clean rings were put into fresh (inhibited) cleaning solution for 24 hours. The iron concentrations as well as the corrosion weight loss rates were determined. The cleaning times were estimated from the iron concentrations versus time plots (FIGS. 27–38). After the cleaning tests, the tubes were exposed to fresh cleaning solution for an additional 24 hours. The corrosion rates were calculated from the difference in iron concentration at the cleaning end-point and at 30 hours (Sec A) and from the total iron pick-up during the second corrosion test (Sec B). These rates are listed below in Table III.

TABLE III

Summary of Results from PENELEC-II Dissolution Tests
2% 4/1 Formic/Carboxylic Acid, 0.25% Inh "B", 200° F.

| Carboxylic Acid | Cleaning Time, Hrs | Corr. Rate-Sec A $lb/ft^2/dy$ | Corr. Rate-Sec B $lb/ft^2/dy$ |
|---|---|---|---|
| Formic (For) | 6.0 | 0.007 | 0.017 |
| Acetic (Ac) | 6.0 | 0.003 | 0.009 |
| Propionic (Pro) | 6.0 | 0.007 | 0.011 |
| Glycolic (Gly) | 6.0 | 0.005 | 0.009 |
| Lactic (Lac) | 5.0 | 0.004 | 0.009 |
| Malonic (Mln) | 5.0 | 0.004 | 0.005 |
| Fumaric (Fum) | 4.0 | 0.006 | 0.007 |
| Succinic (Suc) | 5.0 | 0.002 | 0.005 |
| Glutaric (Glu) | 5.0 | 0.004 | 0.007 |
| Malic (Mal) | 5.0 | 0.004 | 0.006 |
| Tartaric (Tar) | 5.0 | 0.008 | 0.008 |
| Citric (Cit) | 5.0 | 0.005 | 0.005 |

All of the cleaning solutions cleaned the tubes in about 5–6 hours. The most notable differences were in the corrosion rates (especially Sec B). All of the mixed acids gave corrosion rates that were lower than with straight formic acid. The results of these tests for cleaning solutions having a variety of formic acid-carboxylic acid mixtures are illustrated in FIGS. 27–38.

Figure 40:
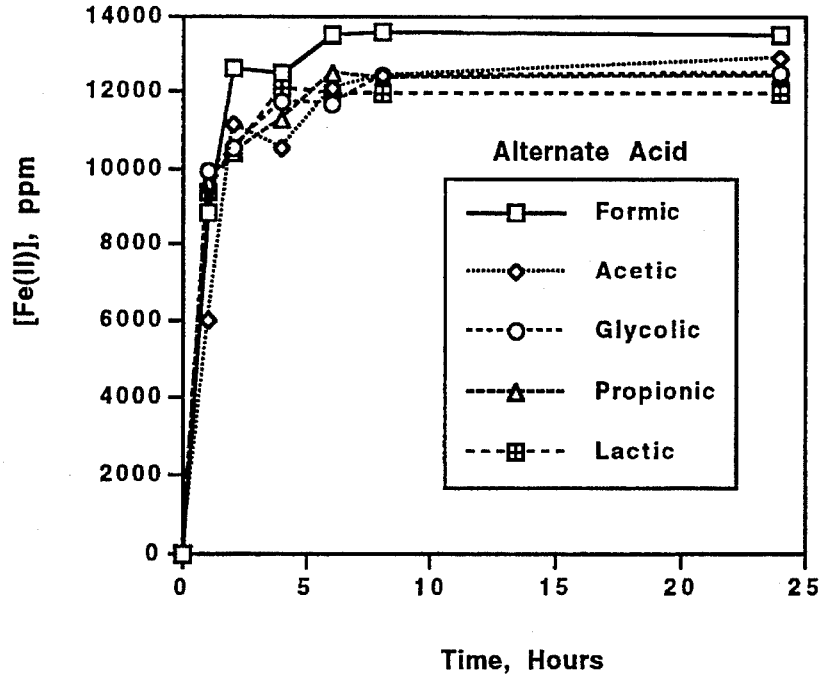
FIGS. 40 and 41 are graphical illustrations of the capacity of 2 percent formic acid and higher organic acid mixtures at a weight ratio of 4:1 to hold iron in the ferrous state, as determined in connection with the present invention, the values shown being in line with the total acidity, i.e., $[H^+]$, of the solvents.
Figure 41:
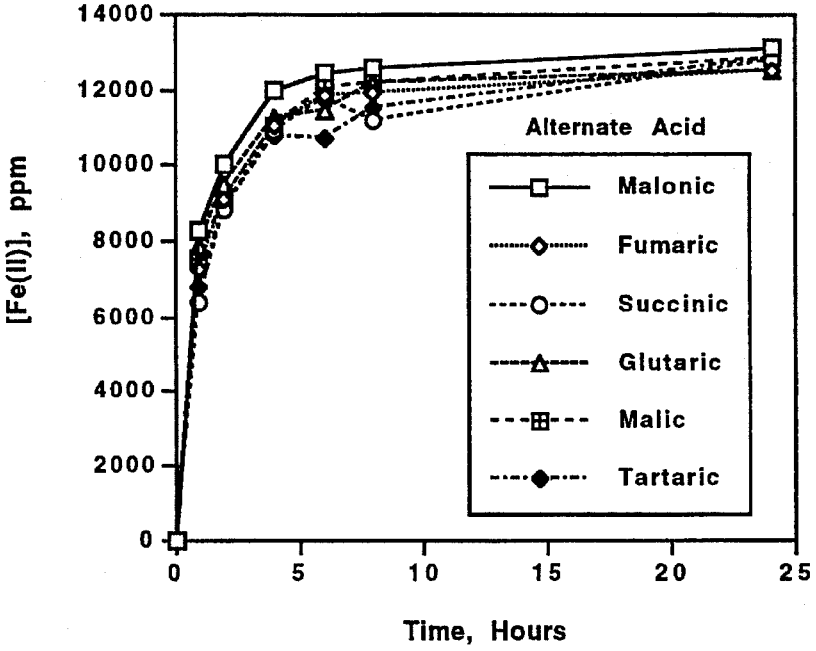

The capacity of the cleaning solutions with alternate carboxylic acids to hold ferrous iron was determined in the manner described above. Briefly, iron powder was heated in a Parr bomb with the uninhibited cleaning solution for 8 hours at 200° F. Samples were collected. After 8 hours, the heat was removed and the bomb was allowed to sit for a total of 24 hours. The ferrous iron concentration of the samples, including a final sample at 24 hours, was determined using ICP spectrophotometry. FIGS. 40 and 41 show the 24 hour ferrous iron capacity tests for cleaning solutions having a variety of formic/carboxylic acid mixtures. As predicted, all of the mixed acid solvents held a stoichiometric amount of ferrous iron (about 12,000 ppm). In several cases (formic acid, propionic acid and several of the other aliphatic acids), there was some evidence of a precipitate. However, it was impossible to unequivocally distinguish the precipitate from the unreacted iron powder. Formic acid/tartaric acid produced a milky-white solution, however, the iron capacity was indistinguishable from the other mixtures.

Figure 43:
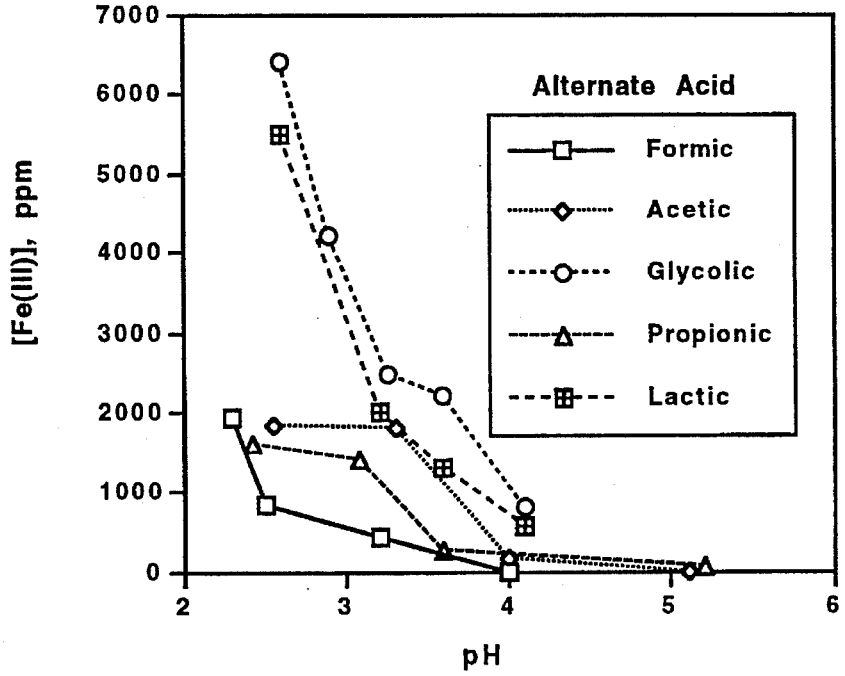
Figure 44:
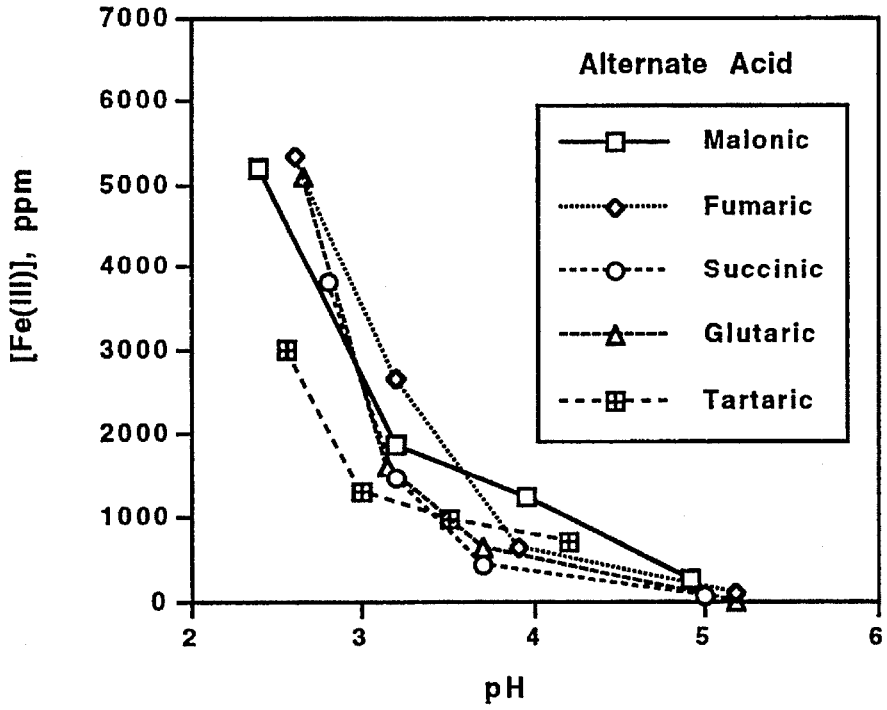
Figure 45:
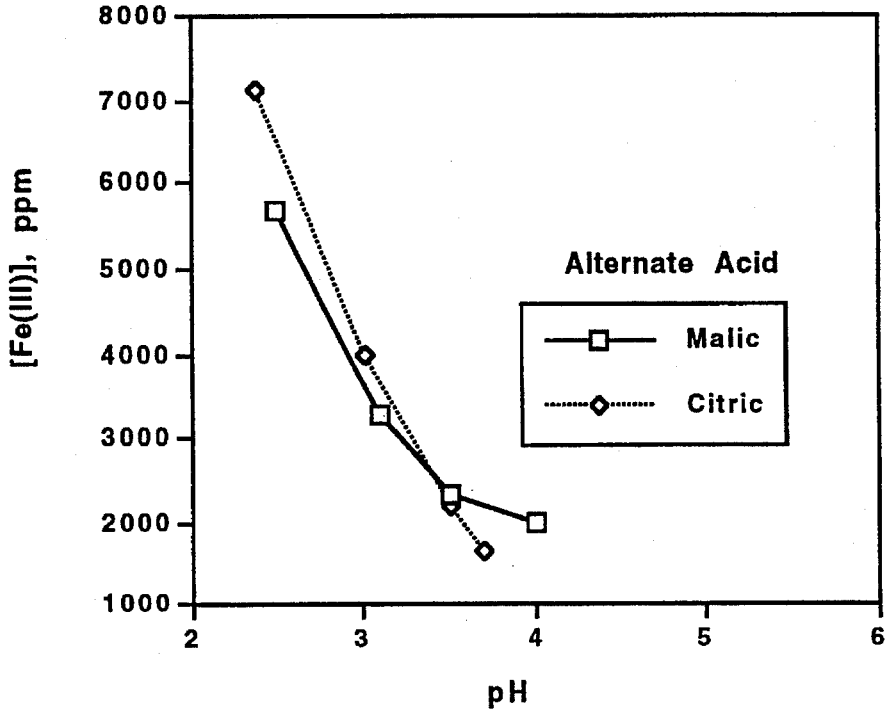

The capacity of the solvent to hold ferric iron was determined by oxidizing the ferrous-containing solutions with hydrogen peroxide and air after the pH of the solution had been adjusted to the desired value with hydrochloric acid. After the oxidized solutions were allowed to sit for 24 hours, the solutions were filtered through a 0.45 micron filter, and the ferric concentration was determined using the $KI/Na_2S_2O_3$ method. The results of these tests for cleaning solutions having a variety of formic acid-carboxylic acid mixtures are illustrated in FIGS. 43–45.

The ferric concentration capacity tests revealed more differences between the acid mixtures. The aliphatic acid mixtures, e.g., acetic, propionic and malonic acids, displayed lower ferric iron capacities than the hydroxy acid mixtures, e.g., glycolic, lactic, malic and citric acids.

It should now be apparent that the formic acid-carboxylic acid mixtures for removing iron oxide scale from steel surfaces within drumless utility boilers as described herein above, possess each of the attributes set forth in the background and summary as desired by the cleaning industry. Because the cleaning solutions and processes described herein can be modified to some extent without departing from the true principles and spirit of the invention as they have been outlined and explained in this specification, the present invention should be understood as encompassing all such modifications as are within the spirit and scope of the following claims.

What is claimed is:

1. A method for removing iron oxide containing scale from interior surfaces of a steel vessel, comprising:

circulating an aqueous cleaning solution through said vessel; and contacting said scale with said aqueous cleaning solution at a temperature between about 150° F. and a boiling point of said aqueous cleaning solution, for a time less than about 30 hours and under a reducing atmosphere so that removed iron remains in solution, said aqueous cleaning solution comprising about 0.5 to about 10.0 percent-by-weight in total of formic acid and at least one carboxylic acid selected from a group consisting of acetic, propionic, glycolic, lactic, malonic, fumaric, succinic, glutaric, malic, tartaric, gluconic and citric acids wherein a weight ratio of formic acid to carboxylic acid is from 4:1 to 9:1, and about 0.1 to about 1.0 percent-by-weight of a corrosion inhibitor effective to limit corrosive attack of organic acids on steel to no more than about 0.015 $lb/ft^2/day$ at the temperature of said contacting.

2. The method of claim 1 further comprising:

draining from said vessel spent cleaning solution containing dissolved scale removed from said vessel;

adding lime and caustic to raise pH of said cleaning solution to at least about 12.5 to precipitate metals dissolved in said solution; and contacting said spent cleaning solution at a pH of at least about 12.5 with a sufficient amount of an oxidizing agent to partially decompose said carboxylic acid and further precipitate metals dissolved in said solution.

3. A method for removing iron oxide containing scale from interior surfaces of a steel vessel, comprising:

contacting said scale with an aqueous cleaning solution comprising about 0.5 to about 10.0 percent-by-weight in total of formic acid and at least one carboxylic acid having from two to six carbon atoms and selected from a group consisting of mono-carboxylic acids, dicarboxylic acids, hydroxycarboxylic acids and polyhydroxycarboxylic acids wherein a weight ratio of formic acid to carboxylic acid is from 4:1 to 20:1; and about 0.1 to about 1.0 percent-by-weight of a corrosion inhibitor effective to inhibit corrosive attack of organic acids on steel; and maintaining a reducing atmosphere in said vessel during said contacting so that removed iron remains in solution.

4. The method of claim 3 wherein said carboxylic acid is hydroxycarboxylic acid.

5. The method of claim 4 wherein said cleaning solution further comprises up to about 1.0 percent-by-weight of a scale dissolution accelerating agent selected from a group consisting of hydrofluoric acid and ammonium bifluoride.

6. A cleaning solution useful for removing iron oxide containing scale from interior surfaces of a steel vessel, comprising:

about 0.5 to about 10.0 percent-by-weight in total of formic acid and at least one carboxylic acid having from two to six carbon atoms and selected from a group consisting of mono-carboxylic acids, dicarboxylic acids, hydroxycarboxylic acids and polyhydroxycarboxylic acids wherein a weight ratio of formic acid to carboxylic acid is greater than 4:1;

about 0.1 to about 1.0 percent-by-weight of a corrosion inhibitor effective to inhibit the corrosive attack of organic acids on steel to no more than about 0.015 $lb/ft^2/day$ at the cleaning temperatures;

up to about 1.0 percent-by-weight of a scale dissolution accelerating agent selected from a group consisting of hydrofluoric acid and ammonium bifluoride; and balance being water.

7. The cleaning solution of claim 6 wherein said organic acid is selected from a group consisting of acetic, propionic, glycolic, lactic, malonic, fumaric, succinic, glutaric, malic, tartaric, gluconic and citric acids.

8. A method for removing iron oxide containing scale from interior surfaces of a steel vessel, comprising:

contacting said scale with an aqueous cleaning solution containing formic acid and at least one carboxylic acid having at least two carbon atoms wherein a weight ratio of formic acid to carboxylic acid is greater than 4:1, said contacting occurring in absence of an oxidizing agent so that removed iron remains in solution.

9. The method of claim 8 further comprising maintaining a reducing atmosphere in said vessel during said contacting.

10. The method of claim 8 wherein said carboxylic acid has from two to six carbon atoms.

11. The method of claim 8 wherein said carboxylic acid is selected from a group consisting of mono-carboxylic acids, dicarboxylic acids, hydroxycarboxylic acids and polyhydroxycarboxylic acids.

12. The method of claim 11 wherein the weight ratio of formic acid to carboxylic acid is from 4:1 to about 9:1.

13. The method of claim 12 wherein said cleaning solution further comprises a corrosion inhibitor effective to inhibit corrosive attack of organic acids on steel.

14. The method of claim 13 wherein said cleaning solution comprises from about 0.1 to about 1.0 percent-by-weight of said corrosion inhibitor.

15. The method of claim 13 wherein said corrosion inhibitor is present in an amount effective to limit corrosion of bared steel in said vessel to no more than about 0.015 $lb/ft^2/day$.

16. The method of claim 13 further comprising maintaining a reducing atmosphere in said vessel during said contacting.

17. The method of claim 16 wherein said reducing atmosphere comprises hydrogen generated in situ by reaction of said acids.

18. The method of claim 12 wherein said formic and carboxylic acids are present in a total amount from about 0.5 to about 10.0 percent-by-weight of said cleaning solution.

19. The method of claim 18 wherein said cleaning solution further comprises up to about 1.0 percent-by-weight of a scale dissolution accelerating agent selected from a group consisting of hydrofluoric acid and ammonium bifluoride.

20. The method of claim 8 wherein said carboxylic acid is selected from a group consisting of acetic, propionic, glycolic, lactic, malonic, fumaric, succinic, glutaric, malic, tartaric, gluconic and citric acids.

21. The method of claim 8 wherein said carboxylic acid is selected from a group consisting of glycolic, lactic, citric, malic and gluconic acids.

22. The method of claim 8 wherein the weight ratio of formic acid to carboxylic acid is from 4:1 to about 20:1.

23. The method of claim 8 wherein said contacting is performed at a temperature between about 150° F. and boiling point of said cleaning solution.

24. The method of claim 8 wherein duration of said contacting is less than about 30 hours.

25. The method of claim 8 wherein said cleaning solution is circulated through said vessel.

* * * * *